US006361148B1

(12) United States Patent
Jonsson et al.

(10) Patent No.: US 6,361,148 B1
(45) Date of Patent: Mar. 26, 2002

(54) DIRECT ELECTROSTATIC PRINTING METHOD AND APPARATUS

(75) Inventors: Tomas Jonsson, Mölndal; Anders Ingelhag, Göteborg; Göran Nybom, Sandby; Henrik Gustavsson, Mölndal; Krister Uvnäs, Lund; Lennart Sjöstedt, Åryd; Lennart Thålin, Mölndal, all of (SE)

(73) Assignee: Array Printers AB, Vastra Frolunda (SE)

( * ) Notice: Subject to any disclaimer, the term of this patent is extended or adjusted under 35 U.S.C. 154(b) by 0 days.

(21) Appl. No.: 09/333,389

(22) Filed: Jun. 15, 1999

(30) Foreign Application Priority Data

Jun. 15, 1998 (EP) ..... 98850106

(51) Int. Cl.[7] ..... B41J 2/06
(52) U.S. Cl. ..... 347/55
(58) Field of Search ..... 347/55, 151, 120, 347/141, 154, 103, 123, 111, 159, 127, 128, 131, 125, 158; 399/271, 290, 292–295

(56) References Cited

U.S. PATENT DOCUMENTS

| | | | |
|---|---|---|---|
| 3,566,786 | A | 3/1971 | Kaufer et al. |
| 3,689,935 | A | 9/1972 | Pressman et al. |
| 3,779,166 | A | 12/1973 | Pressman et al. |
| 3,815,145 | A | 6/1974 | Tisch et al. |
| 4,263,601 | A | 4/1981 | Nishimura et al. |
| 4,274,100 | A | 6/1981 | Pond |
| 4,353,080 | A | 10/1982 | Cross |
| 4,382,263 | A | 5/1983 | Fischbeck et al. |
| 4,384,296 | A | 5/1983 | Torpey |
| 4,386,358 | A | 5/1983 | Fischbeck |
| 4,470,056 | A | 9/1984 | Galetto et al. |
| 4,478,510 | A | 10/1984 | Fujii et al. |

(List continued on next page.)

FOREIGN PATENT DOCUMENTS

| | | |
|---|---|---|
| DE | 12 70 856 | 6/1968 |
| DE | 26 53 048 | 5/1978 |
| EP | 0345 024 A2 | 6/1989 |
| EP | 0352 997 A2 | 1/1990 |
| EP | 0377 208 A2 | 7/1990 |
| EP | 0389 229 | 9/1990 |
| EP | 0660 201 A2 | 6/1995 |
| EP | 0703 080 A2 | 3/1996 |
| EP | 072 072 A2 | 7/1996 |
| EP | 0 743 571 A1 | 11/1996 |

(List continued on next page.)

OTHER PUBLICATIONS

"The Best of Both Worlds," Brochure of Toner Jet by Array Printers, The Best of Both Worlds, 1990.

International Congress on Advances in Non–Impact Printing Technologies, 1994, pp. 311–313.

E. Bassous, et al., "The Fabrication of High Precision Nozzles by the Anisotropic Etching of (100) Silicon", J. Electrochem. Soc.: Solid–State Science and Technology, vol. 125, No. 8, Aug. 1978, pp. 1321–1327.

*Primary Examiner*—Raquel Yvette Gordon
(74) *Attorney, Agent, or Firm*—Knobbe, Martens, Olson & Bear, LLP

(57) ABSTRACT

A direct electrostatic printing device and method print an image to an information carrier with improved alignment between printed part images from two or more print stations. The improved alignment is based on a basic mechanical alignment with a basic accuracy between the print stations which is improved by an electronic alignment of the corresponding bitmaps. The electronic alignment is made possible by the capability of at least one print station to print at least one additional dot in relation to the corresponding bitmap. The minimum number of additional dots being dependent on the attained basic accuracy of the basic mechanical alignment.

24 Claims, 15 Drawing Sheets

U.S. PATENT DOCUMENTS 4,491,855 A 1/1985 Fujii et al.
4,498,090 A 2/1985 Honda et al.
4,511,907 A 4/1985 Fukuchi
4,525,727 A 6/1985 Kohashi et al.
4,571,601 A 2/1986 Teshima
4,675,703 A 6/1987 Fotland
4,717,926 A 1/1988 Hotomi
4,743,926 A 5/1988 Schmidlin et al.
4,748,453 A 5/1988 Lin et al.
4,814,796 A 3/1989 Schmidlin
4,831,394 A 5/1989 Ochiai et al.
4,860,036 A 8/1989 Schmidlin
4,903,050 A 2/1990 Schmidlin
4,912,489 A 3/1990 Schmidlin
5,028,812 A 7/1991 Bartky
5,036,341 A 7/1991 Larsson
5,038,159 A 8/1991 Schmidlin et al.
5,057,855 A 10/1991 Damouth
5,072,235 A 12/1991 Slowik et al.
5,083,137 A 1/1992 Badyal et al.
5,095,322 A 3/1992 Fletcher
5,121,144 A 6/1992 Larson et al.
5,128,695 A 7/1992 Maeda
5,148,595 A 9/1992 Doggett et al.
5,170,185 A 12/1992 Takemura et al.
5,181,050 A 1/1993 Bibl et al.
5,204,696 A 4/1993 Schmidlin et al.
5,204,697 A 4/1993 Schmidlin
5,214,451 A 5/1993 Schmidlin
5,229,794 A 7/1993 Honma et al.
5,235,354 A 8/1993 Larson
5,237,346 A 8/1993 Da Costa et al.
5,256,246 A 10/1993 Kitamura
5,257,045 A 10/1993 Bergen et al.
5,270,729 A 12/1993 Stearns
5,274,401 A 12/1993 Doggett et al.
5,307,092 A 4/1994 Larson
5,329,307 A 7/1994 Takemura et al.
5,374,949 A 12/1994 Wada et al.
5,386,225 A 1/1995 Shibata
5,402,158 A 3/1995 Larson
5,414,500 A 5/1995 Furukawa
5,446,478 A 8/1995 Larson
5,450,115 A 9/1995 Bergen et al.
5,453,768 A 9/1995 Schmidlin
5,473,352 A 12/1995 Ishida
5,477,246 A 12/1995 Hirabayashi et al.
5,477,250 A 12/1995 Larson
5,506,666 A 4/1996 Masuda et al.
5,508,723 A 4/1996 Maeda
5,515,084 A 5/1996 Larson
5,526,029 A 6/1996 Larson et al.
5,558,969 A 9/1996 Uyttendaele et al.
5,559,586 A 9/1996 Wada
5,600,355 A 2/1997 Wada
5,614,932 A 3/1997 Kagayama
5,617,129 A 4/1997 Chizuk, Jr. et al
5,625,392 A 4/1997 Maeda
5,640,185 A 6/1997 Kagayama
5,650,809 A 7/1997 Kitamura
5,666,147 A 9/1997 Larson
5,677,717 A 10/1997 Ohashi
5,708,464 A 1/1998 Desie
5,774,153 A 6/1998 Kuehnle et al.
5,774,159 A 6/1998 Larson
5,805,185 A 9/1998 Kondo
5,818,480 A 10/1998 Bern et al.
5,818,490 A 10/1998 Larson
5,847,733 A 12/1998 Bern
5,867,191 A 2/1999 Luque
5,889,542 A 3/1999 Albinsson
6,027,206 A * 2/2000 Bern et al. ..... 357/55

FOREIGN PATENT DOCUMENTS

EP 0752 317 A1 1/1997
EP 0764 540 A2 3/1997
GB 2108432 5/1983
JP 4426333 11/1969
JP 5555878 4/1980
JP 584671 6/1980
JP 5587563 7/1980
JP 5689576 7/1981
JP 58044457 3/1983
JP 58155967 9/1983
JP 62 248662 10/1987
JP 6213356 11/1987
JP 01120354 5/1989
JP 05220963 8/1990
JP 04189554 8/1992
JP 04 268591 9/1992
JP 4282265 10/1992
JP 5208518 8/1993
JP 93331532 12/1993
JP 94200563 8/1994
JP 9048151 2/1997
JP 09118036 5/1997
WO 9014960 12/1990

* cited by examiner 52
7
61
62
60
6
54
63
54
10
13

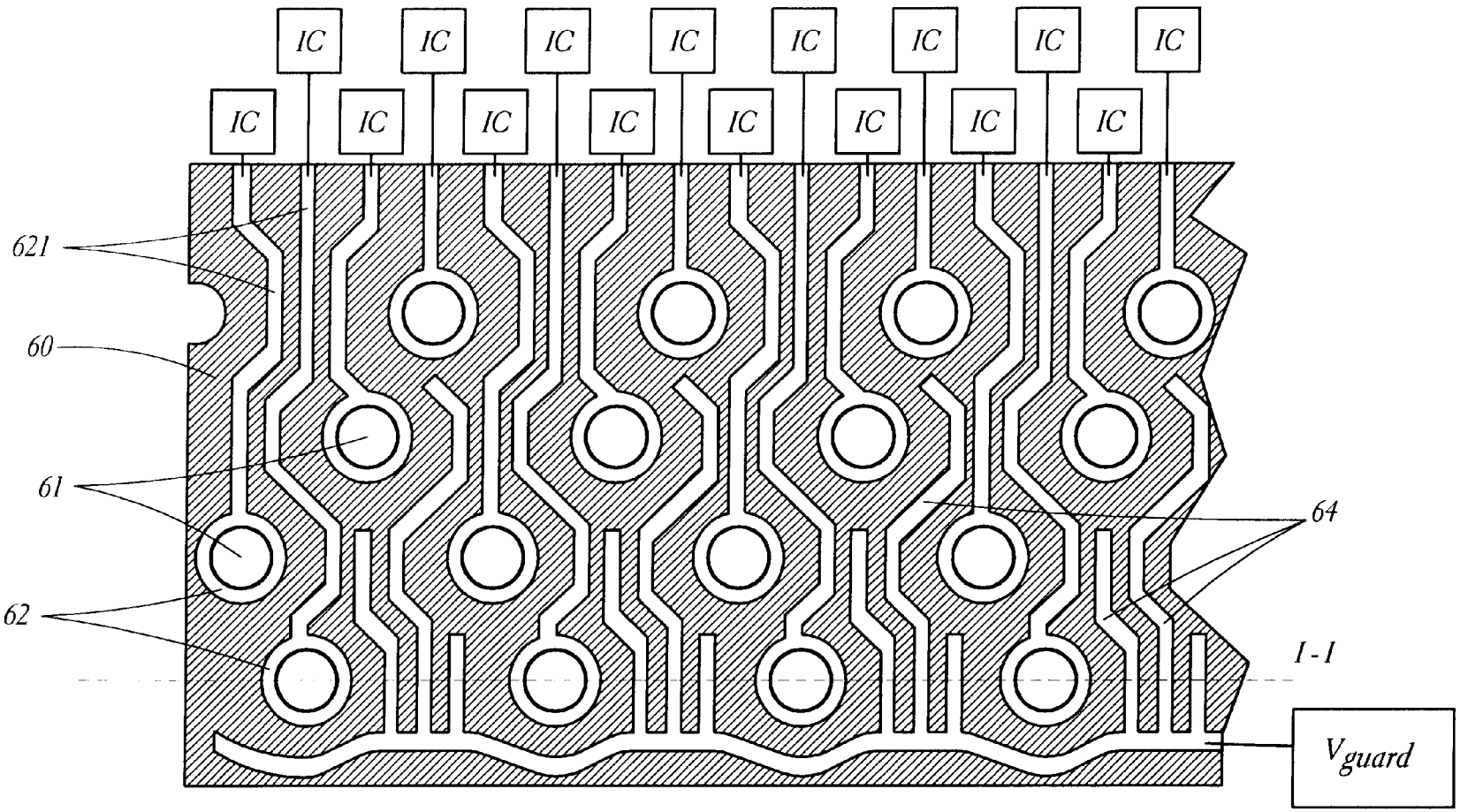
IC
IC
IC

DIRECT ELECTROSTATIC PRINTING METHOD AND APPARATUS

FIELD OF THE INVENTION

The present invention relates to direct electrostatic printing methods in which charged toner particles are transported under control from a particle source in accordance with an image information to form a toner image used in a copier, a printer, a plotter, a facsimile, or the like.

BACKGROUND TO THE INVENTION

According to a direct electrostatic printing method, such as that disclosed in U.S. Pat. No. 5,036,341, a background electric field is produced between a developer sleeve and a back electrode to enable the transport of charged toner particles therebetween. A printhead structure, such as an electrode matrix provided with a plurality of selectable apertures, is interposed in the background electric field and connected to a control unit which converts an image information into a pattern of electrostatic control fields which selectively open or close the apertures, thereby permitting or restricting the transport of toner particles from the developer sleeve. The modulated stream of toner particles allowed to pass through opened apertures impinges upon an information carrier, such as paper, conveyed between the printhead structure and the back electrode, to form a visible image.

According to such a method, each single aperture is utilized to address a specific dot position of the image in a transverse direction, i.e. perpendicular to paper motion. Thus, the transversal print addressability is limited by the density of apertures through the printhead structure. For instance, a print addressability of 300 dpi requires a printhead structure having 300 apertures per inch in a transversal direction.

A new concept of direct electrostatic printing, hereinafter referred to as dot deflection control (DDC), was introduced in U.S. patent application Ser. No. 08/621,074. According to the DDC method each sin gle aperture is used to address several dot positions on an information carrier by controlling not only the transport of toner particles through the aperture, but also their transport trajectory toward a paper, and thereby the location of the obtained dot. The DDC method increases the print addressability without requiring a larger number of apertures in the printhead structure. This is achieved by providing the printhead structure with at least two sets of deflection electrodes connected to variable deflection voltages which, during each print cycle, sequentially modify the symmetry of the electrostatic control fields to deflect the modulated stream of toner particles in predetermined deflection directions.

For instance, a DDC method performing three deflection steps per print cycle, provides a print addressability of 600 dpi utilizing a printhead structure having 200 apertures per inch. An improved DDC method, disclosed in U.S. patent application Ser. No. 08/759,481, provides a simultaneous dot size and dot position control. This later method utilizes the deflection electrodes to influence the convergence of the modulated stream of toner particles thus controlling the dot size. According to the method, each aperture is surrounded by two deflection electrodes connected to a respective deflection voltage D1, D2, such that the electrode field generated by the control electrodes remains substantially symmetrical as long as both deflection voltages D1, D2 have the same amplitude. The amplitudes of D1 and D2 are modulated to apply converging forces on toner to obtain smaller dots. The dot position is simultaneously controlled by modulating the amplitude difference between D1 and D2. Utilizing this improved method enables 60 $\mu$m dots to be obtained utilizing 160 $\mu$m apertures.

With or without DDC in direct electrostatic printing methods a plurality of apertures, each surrounded by a control electrode, are preferably arranged in parallell rows extending transversally across the print zone, i.e. at a right angle to the motion of the image receiving medium. As a pixel position on the image receiving medium passes beneath a corresponding aperture, the control electrode associated with this aperture is set on a print potential allowing the transport of toner particles through the aperture to form a toner dot at that pixel position. Accordingly, transverse image lines can be printed by simultaneously activating several apertures of the same aperture row.

However, it can be considered a drawback of current direct electrostatic printing methods that sometimes when printing an image the perceived image density of individual apertures varies over time for the same desired image density. It can also be considered a drawback of current direct electrostatic printing methods that the mechanical precision of interrelating parts of the printer has to be very high.

SUMMARY OF THE INVENTION

An object of the present invention is to provide a method of and device for harmonizing the apparent time varying behaviour of different apertures in direct electrostatic printing methods.

A further object of the present invention is to provide a method of direct electrostatic printing which temporally harmonizes the apparent behaviour of individual apertures.

Still a further object of the present invention is to provide a method of and a device for harmonizing a perceived image density with a desired image density in direct electrostatic printing methods.

Yet a further object of the present invention is to provide a method of and a device for decreasing the need for an extremely high mechanical precision during manufacturing of printers working according to direct electrostatic printing methods.

Another object of the present invention is to provide a method of and device for reducing or eliminating perceived uneven image density in direct electrostatic printing methods.

Still another object of the present invention is to provide a method of and a device for trajecting a predetermined, within a predetermined margin, amount of toner/pigment particles to predetermined positions in view of an image which is to be printed.

Yet another object of the present invention is to provide a method of and a device for for reducing or eliminating perceived uneven image density in direct electrostatic printing methods due to mechanical imperfections.

Yet another object of the present invention is to provide a method of and a device for for reducing or eliminating the influence of distance variations between a printhead structure and a pigment source due to mechanical imperfections.

Said objects are achieved according to the invention by providing a direct electrostatic printing device and method for printing an image to an information carrier with increased density harmonization. This is attained by measuring the apparent temporal behaviour of the apertures and subsequently temporally adjusting the control parameters of at least the apertures that seem to temporally diverge during printing. The measurement of the behaviour of the apertures is suitably performed by scanning a known print sample with a predetermined density. The scanned values are inverted around a predetermined value for which no compensation is done to create a two dimensional compensation function. At least the apertures which have an apparent temporal behaviour which diverges from a predetermined behaviour are compensated according to the compensation function of the respective aperture, thereby enabling an increased density harmonization. The compensation function can preferably be signal processed by, for example, a low pass filtering.

Said objects are also achieved according to the invention by providing a direct electrostatic printing device and method for printing an image to an information carrier with increased density harmonization during printing. This is attained by measuring undesired image density variations in a direction parallel to the relative movement between an image receiving member and a printhead structure. The density variations are caused by distance variations between the printhead structure and a pigment particle source during printing, which at least in part is caused by a relative movement between at least a part of the pigment particle source and the printhead structure. A control unit is arranged to control the transport of pigment particles in such a way as to compensate for these undesired image density variations during printing, thus attaining a percepted uniform printed image density along a printed image for a specific desired image density.

Said objects are also achieved according to the invention by providing a direct electrostatic printing device and method for printing an image to an information carrier with improved alignment between printed part images from two or more print stations. The improved alignment is based on a basic mechanical alignment with a basic accuracy between the print stations which is improved by an electronic alignment of the corresponding bitmaps. The electronic alignment is made possible by the capability of at least one print station to print at least one additional dot in relation to the corresponding bitmap. The minimum number of additional dots being dependent on the attained basic accuracy of the basic mechanical alignment.

Said objects are also achieved according to the invention by providing a direct electrostatic printing device according to claim 1. The dependent claims 2 to 23 disclose advantageous embodiments of the invention.

Said objects are also achieved according to the invention by a method for printing an image to an information carrier according to the steps of claim 24. Further method variations of the method according to the invention are possible according to previously described enhancements in view of the application of the invention according to claims 2 to 23.

The present invention satisfies a need for density harmonization not previously met.

The present invention relates to an image recording apparatus including an image receiving member conveyed past one or more, so called, print stations to intercept a modulated stream of toner particles from each print station. A print station includes a particle delivery unit, a particle source, such as a developer sleeve, and a printhead structure arranged between the particle source and the image receiving member. The printhead structure includes means for modulating the stream of toner particles from the particle source and means for controlling the trajectory of the modulated stream of toner particles toward the image receiving member.

According to a preferred embodiment of the present invention, the image recording apparatus comprises four print stations, each corresponding to a pigment colour, e.g. yellow, magenta, cyan, black (Y, M, C, K), disposed adjacent to an image receiving member formed of a seamless transfer belt made of a substantially uniformly thick, flexible material having high thermal resistance, high mechanical strength and stable electrical properties under a wide temperature range. The toner image is formed on the transfer belt and thereafter brought into contact with an information carrier, e.g. paper, in a fuser unit, where the toner image is simultaneously transferred to and made permanent on the information carrier upon heat and pressure. After image transfer, the transfer belt is brought in contact with a cleaning unit removing untransferred toner particles.

Other objects, features and advantages of the present inventions will become more apparent from the following description when read in conjunction with the accompanying drawings in which preferred embodiments of the invention are shown by way of illustrative examples.

BRIEF DESCRIPTION OF THE DRAWINGS

The invention will now be described in more detail for explanatory, and in no sense limiting, purposes, with reference to the following drawings, wherein like reference numerals designate like parts throughout and where the dimensions in the drawings are not to scale, in which FIG. 6*a* is a schematic plan view of the top side of a printhead structure used in a print station such as that shown in FIG. 3.

DESCRIPTION OF PREFERRED EMBODIMENTS

In order to clarify the method and device according to the invention, some examples of its use will now be described in connection with FIGS. 1 to 13.

Figure 1:
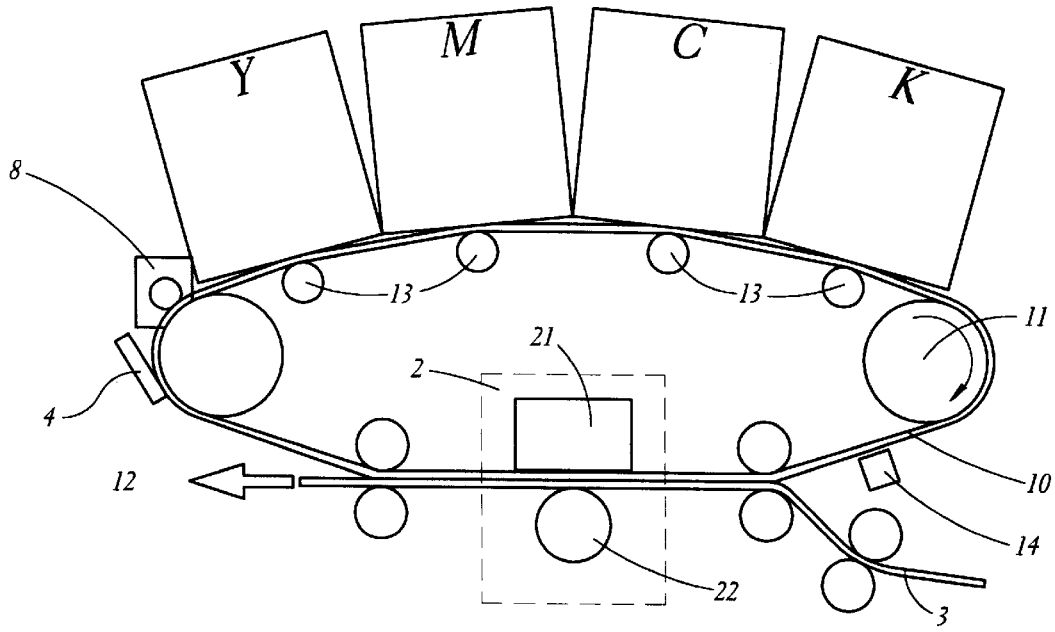
FIG. 1 is a schematic section view across an image recording apparatus according to a preferred embodiment of the invention.

FIG. 1 is a schematic section view of an image recording apparatus according to a first embodiment of the invention, comprising at least one print station, preferably four print stations (Y, M, C, K), an intermediate image receiving member, a driving roller 11, at least one support roller 12, and preferably several adjustable holding elements 13. The four print stations (Y, M, C, K) are arranged in relation to the intermediate image receiving member. The intermediate image receiving member, preferably a transfer belt 10, is mounted over the driving roller 11. The at least one support roller 12 is provided with a mechanism for maintaining the transfer belt 10 with at least a constant surface tension, while preventing transversal movement of the transfer belt 10. The preferably several adjustable holding elements 13 are for accurately positioning the transfer belt 10 at least with respect to each print station.

The driving roller 11 is preferably a cylindrical metallic sleeve having a rotational axis extending perpendicular to the belt motion and a rotation velocity adjusted to convey the transfer belt 10 at a velocity of one addressable dot location per print cycle, to provide line by line scan printing. The adjustable holding elements 13 are arranged for maintaining the surface of the transfer belt 10 at a predetermined distance from each print station. The holding elements 13 are preferably cylindrical sleeves disposed perpendicularly to the belt motion in an arcuated configuration for slightly bending the transfer belt 10 at least in the vicinity of each print station. The transfer belt 10 is slightly bent in order to, in combination with the belt tension, create a stabilization force component on the transfer belt 10. The stabilization force component is opposite in direction and preferably larger in magnitude than an electrostatic attraction force component acting on the transfer belt 10. The electrostatic attraction forces at a print station are created by induction charging of the belt and by different electric potentials on the holding elements 13 and on the print station in question.

The transfer belt 10 is preferably an endless band of 30 to 200 $\mu$m thick composite material as a base. The base composite material can suitably include thermoplastic polyamide resin or any other suitable material having a high thermal resistance, such as 260° C. of glass transition point and 388° C. of melting point, and stable mechanical properties under temperatures in the order of 250° C. The composite material of the transfer belt 10 preferably has a homogeneous concentration of filler material, such as carbon or the like, which provides a uniform electrical conductivity throughout the entire surface of the transfer belt 10. The outer surface of the transfer belt 10 is preferably overlaid with a 5 to 30 $\mu$m thick coating layer made of electrically conductive polymere material such as for instance PTFE (poly tethra fluoro ethylene), PFA (tetra flouro ethylene, perflouro alkyl vinyl ether copolymer), FEP (tetra flouro ethylene hexaflouro, propylene copolymer), silicone, or any other suitable material having appropriate conductivity, thermal resistance, adhesion properties, release properties, and surface smoothness. To further improve for example the adhesion and release properties a layer of silicone oil can be applied to either the transfer belt base or preferably onto a coating layer if it is applied onto the transfer belt base. The silicone oil is coated evenly onto the transfer belt 10 preferably in the order of 0.1 to 2 $\mu$m thick giving a consumption of silicone oil in the region of 1 centiliter for every 1000 pages. Silicone oil also reduces bouncing/-scattering of toner particles upon reception of toner particles and also increases the subsequent transfer of toner particles to an information carrier. Making use of silicone oil and especially coating of the transfer belt with silicone oil is made possible in an electrostatic printing method according to the present invention as there is no direct physical contact between a toner delivery and a toner recipient, i.e. the transfer belt, in this embodiment.

In some embodiments the transfer belt 10 can comprise at least one separate image area and at least one of a cleaning area and/or a test area. The image area being intended for the deposition of toner particles, the cleaning area being intended for enabling the removal of unwanted toner particles from around each of the print stations, and the test area being intended for receiving test patterns of toner particles for calibration purposes. The transfer belt 10 can also in certain embodiments comprise a special registration area for use of determining the position of the transfer belt, especially an image area if available, in relation to each print station. If the transfer belt comprises a special registration area then this area is preferably at least spatially related to an image area.

The transfer belt 10 is conveyed past the four different print stations (Y, M, C, K), whereby toner particles are deposited on the outer surface of the transfer belt 10 and superposed to form a toner image. Toner images are then preferably conveyed through a fuser unit 2, comprising a fixing holder 21 arranged transversally in direct contact with the inner surface of the transfer belt. In some embodiments of the invention the fuser unit is separated from the transfer belt 10 and only acts on an information carrier. The fixing holder 21 includes a heating element preferably of a resistance type of e.g. molybdenium, maintained in contact with the inner surface of the transfer belt 10. As an electric current is passed through the heating element, the fixing holder 21 reaches a temperature required for melting the toner particles deposited on the outer surface of the transfer belt 10. The fuser unit 2 further comprises a pressing roller 22 arranged transversally across the width of the transfer belt 10 and facing the fixing holder 21. An information carrier 3, such as a sheet of plain, untreated paper or any other medium suitable for direct printing, is fed from a paper delivery unit (not shown) and conveyed between the pressing roller 22 and the transfer belt 10. The pressing roller 22 rotates with applied pressure to the heated surface of the fixing holder 21 whereby the melted toner particles are fused on the information carrier 3 to form a permanent image. After passage through the fusing unit 2, the transfer belt is brought in contact with a cleaning element 4, such as for example a replaceable scraper blade of fibrous material extending across the width of the transfer belt 10 for removing all untransferred toner particles. If the transfer belt 10 is to be coated with silicone oil or the like, then preferably after the cleaning element 4, and before the printing stations, the transfer belt 10 is brought into contact with a coating application element 8 for evenly coating the transfer belt with silicone oil or the like. In other embodiments toner particles are deposited directly onto an information carrier without first being deposited onto an intermediate image receiving member.

Whenever more than one print station is used, and as in the preferred embodiment four print stations are used, each corresponding to a pigment colour, e.g. yellow, magenta, cyan, black (Y, M, C, K), then it is important that their relative position is known so that toner particles can be deposited in correct positions on the outer surface of the transfer belt 10 and thereby superpose to form a toner image. When printing at 600 dpi then the center to center distance between dots is approximately 42 $\mu$m, which means that each print station should preferably be positioned within ±21 $\mu$m from a predetermined position so that dots can superpose in a correct manner and form the intended toner image. To directly manufacture something that will enable the print stations to be positioned relative each other with such an accuracy would be prohibitively expensive. Such a high accuracy can probably be obtained by providing mechanical calibration means that are used to adjust the the relative positions of the print stations in a set up after manufacture. However, there are several characteristics of the mechanical calibration means that could be considered to be disadvantageous if used alone. High quality mechanical calibration means are expensive, an exact labor intensive calibration needs to be done during manufacture, the calibration might be influenced by temperature, humidity and transport, and the calibration must probably be redone after exchange of, or some kind of work is done with, one of the print stations.

According to one aspect of the invention, an electronic calibration is performed, possibly in combination with a coarse mechanical calibration By providing an electronic calibration which acts as a filter on the image data to each print station, each print station can be given a predetermined virtual relative position. The filter will rotate, scale, and/or translate the image data in order to compensate for any mechanical positional misalignments that the print stations might have in relation to each other. In order to be able to print and fill an entire information carrier with a desired pattern even though the print stations are mechanically misaligned relative to each other and relative to a transfer belt (or the information carrier directly) then preferably each print station should have at least the possibility to print one extra dot on each side, i.e. each print station should preferably have at least one redundant dot on each side. In some embodiments it is preferable that at least one of the print stations has at least one extra aperture on at least one side. The number of additional dots and possibly additional apertures that the print stations should have, will depend on the initial mechanical positional accuracy that can be attained directly at manufacturing and possibly additonally by means of some kind of coarse mechanical calibration. The available dots must cover the entire desired area that is to be printed, even when the print stations is at their most mechanically misaligned state. The electronic calibration also has the advantage that a difference between the different print stations of their aperture. to aperture distances can be compensated for.

The electronic calibration according to the invention, also called registration, can be done automatically, semi-automatically, or manually. Preferably the registration is performed automatically or at least semi-automatically. A manual registration can take place by entering the image recording apparatus into a manual registration mode after which it will preferably print test patterns onto an information carrier. A user can then, after inspection of the test patterns, specify and feed the registration filter with parameters specifying an estimated degree of rotation, translation, and/or scaling that is needed for each print station. The procedure will then preferably be repeated until it can be confirmed that the correct registration has been attained.

A semi automatic registration can take place by entering the image recording apparatus into a semi-automatic registration mode after which it will preferably print a number of identifiable, for example numbered, test patterns which have different amounts of rotation, translation, and scaling for the different print stations. A user should then identify which test pattern or patterns that give a correct registration for the print stations and feed the identification of this or these test patterns to the registration filter. If necessary, this process can also be repeated to refine the registration.

An automatic registration can take place if the image recording apparatus is also equiped with some sort of test pattern sensing means 14 or if some sort of test pattern sensing means is provided externally. If an external test pattern sensing means is used then test patterns preferably should be printed onto an information carrier and alternatively if an internal test pattern sensing means 14 is used then the test pattern should preferably only be printed onto the transfer belt. If internal test pattern sensing means are provided, they can alternatively be arranged in relation to or directly on each print station and one or more test patterns be permanently provided on the transfer belt. An advantage of this is that the sensing would not have to be optical but could advantageously be magnetic or capacitive. For a complete self contained automatic registration the test patterns should preferably only be printed onto the transfer belt, in some embodiments preferably only onto a test area on the transfer belt, and then sensed internally. The test patterns are analyzed and it is determined how much, if any, rotation, translation, and/or scaling is needed for each print station. The aquired parameters for these corrections are thereafter fed into the registration filter. If a test area is provided then an automatic registration can take place when needed without any user interaction or knowledge that an automatic registration is taking place. A need to perform an automatic registration can, for example, be at (or in the semiautomatic and manual cases, user initiated due to) every power-on, every X-number of pages printed, every X-number of hours, due to temperature variations, due to humidity variations, after a service, repair, and/or replacement, on user demand, or any combination of these. Temperature and/or humidity sensors can be provided for this purpose.

Figure 2:
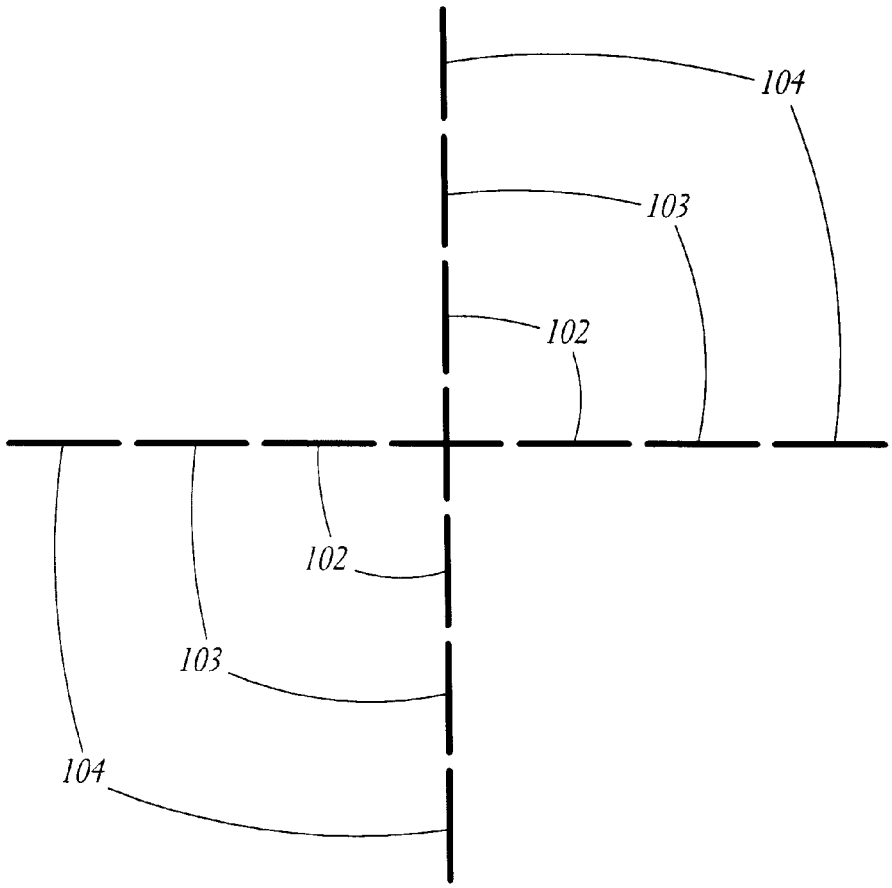
FIG. 2 is an example of a test pattern for registration.

The test patterns used can, for example, as is shown in FIG. 2 look like an extended plus sign 100 where the core plus sign 101 is printed by a reference print station and the extensions 102, 103, 104 are printed by the other print stations. The test patterns 100 can of course be of another suitable shape and construction. Preferably the different parts of a test pattern should be identifiable as to which print station printed it, due to the relative positions of the parts. In a minimal test run at least two test patterns 100 are printed as far apart as possible in a direction which is perpendicular to a direction of movement of the transfer belt/information carrier. By using a plurality of test patterns 100 evenly spaced in a direction which is perpendicular to a direction of movement of the transfer belt/information carrier non-linear scaling problems in a print stations can be detected and subsequently corrected.

Preferably the black print station is used as a reference color and is not electronically calibrated. Black is the color with the highest contrast and is used for text, among other things, which results in that it is the most "visible" color and therefore the most sensitive to any kind of distortion which can result from an electronic calibration. A black print station will not need the ability to print extra dots if no electronic calibration is done with that print station. However, all the print stations will probably be identical due to manufacturing advantages that can be attained by them being identical.

The registration filter for translation, rotation, and/or scaling of image data to each print station and the optional test pattern analyzing and calibration determination means are suitably comprised in a control unit, see further below.

Figure 3:
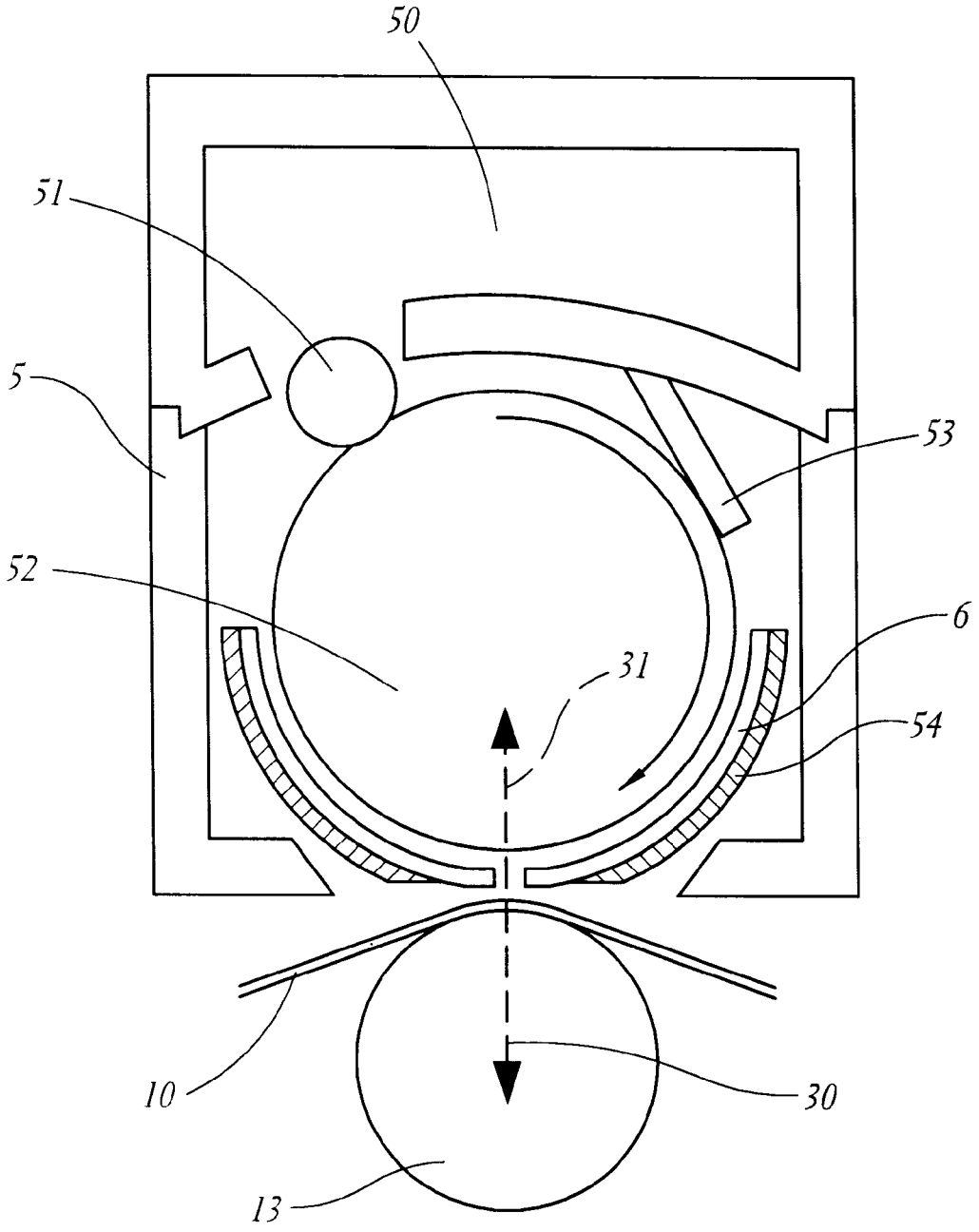
FIG. 3 is a schematic section view across a particular print station of the image recording apparatus shown in FIG. 1.

FIG. 3 is a schematic section view of one embodiment of a print station in, for example, the image recording apparatus shown in FIG. 1. A print station includes a particle delivery unit 5 preferably having a replaceable or refillable container 50 for holding toner particles, the container 50 having front and back walls, a pair of side walls and a bottom wall having an elongated opening extending from the front wall to the back wall and provided with a toner feeding element (not shown) disposed to continuously supply toner particles to a developer sleeve 52 through a particle charging member. The particle charging member can preferably be formed of a supply brush 51 or a roller made of or coated with a fibrous, resilient material. The supply brush 51 can suitably in some embodiments be brought into mechanical contact with the peripheral surface of the developer sleeve 52, for charging particles by contact charge exchange due to triboelectrification of the toner particles through frictional interaction between the fibrous material on the supply brush 51 and any suitable coating material of the developer sleeve 52. The developer sleeve 52 is preferably made of metal which can, for example, be coated with a conductive material, and preferably have a substantially cylindrical shape and a rotation axis extending parallel to the elongated opening of the particle container 50. Charged toner particles are held to the surface of the developer sleeve 52 by electrostatic forces essentially proportional to $(Q/D)^2$, where Q is the particle charge and D is the distance between the particle charge center and the boundary of the developer sleeve 52. Alternatively, the charging unit may additionally comprise a charging voltage source (not shown), which supply an electric field to induce or inject charge to the toner particles. Although it is preferred to charge particles through contact charge exchange, the method can be performed by using any other suitable charge unit, such as a conventional charge injection unit, a charge induction unit or a corona charging unit, without departing from the scope of the present invention.

A metering element 53 is positioned proximate to the developer sleeve 52 to adjust the concentration of toner particles on the peripheral surface of the developer sleeve 52, to form a relatively thin, uniform particle layer thereon. In some embodiments the metering element 53 also suitably contributes to the charging of the toner particles. The metering element 53 may be formed of a flexible or rigid, insulating or metallic blade, roller or any other member suitable for providing a uniform particle layer thickness. The metering element 53 may also be connected to a metering voltage source (not shown) which influence the triboelectrification of the particle layer to ensure a uniform particle charge distribution and mass density on the surface of the developer sleeve 52.

The developer sleeve 52 is arranged in relation with a support device 54 for supporting and maintaining the printhead structure 6 in a predetermined position with respect to the peripheral surface of the developer sleeve 52. The support device 54 is preferably in the form of a trough-shaped frame having two side walls, a bottom portion between the side walls, and an elongated slot arranged through the bottom portion, extending transversally across the print station, parallel to the rotation axis of the developer sleeve 52. The support device 54 further comprises means for maintaining the printhead structure in contact with the bottom portion of the support device 54, the printhead structure 6 thereby bridging the elongated slot in the bottom portion.

The transfer belt 10 is preferably slightly bent partly around each holding element 13 in. order to create a stabilization force component 30. The stabilization force component 30 is intended to counteract, among other things, a field force component 31 which is acting on the transfer belt. If the field force component 31 is not counteracted it can cause distance fluctuations between the transfer belt 10 and the printhead structure 6 which can cause a degradation in print quality.

Figure 4:
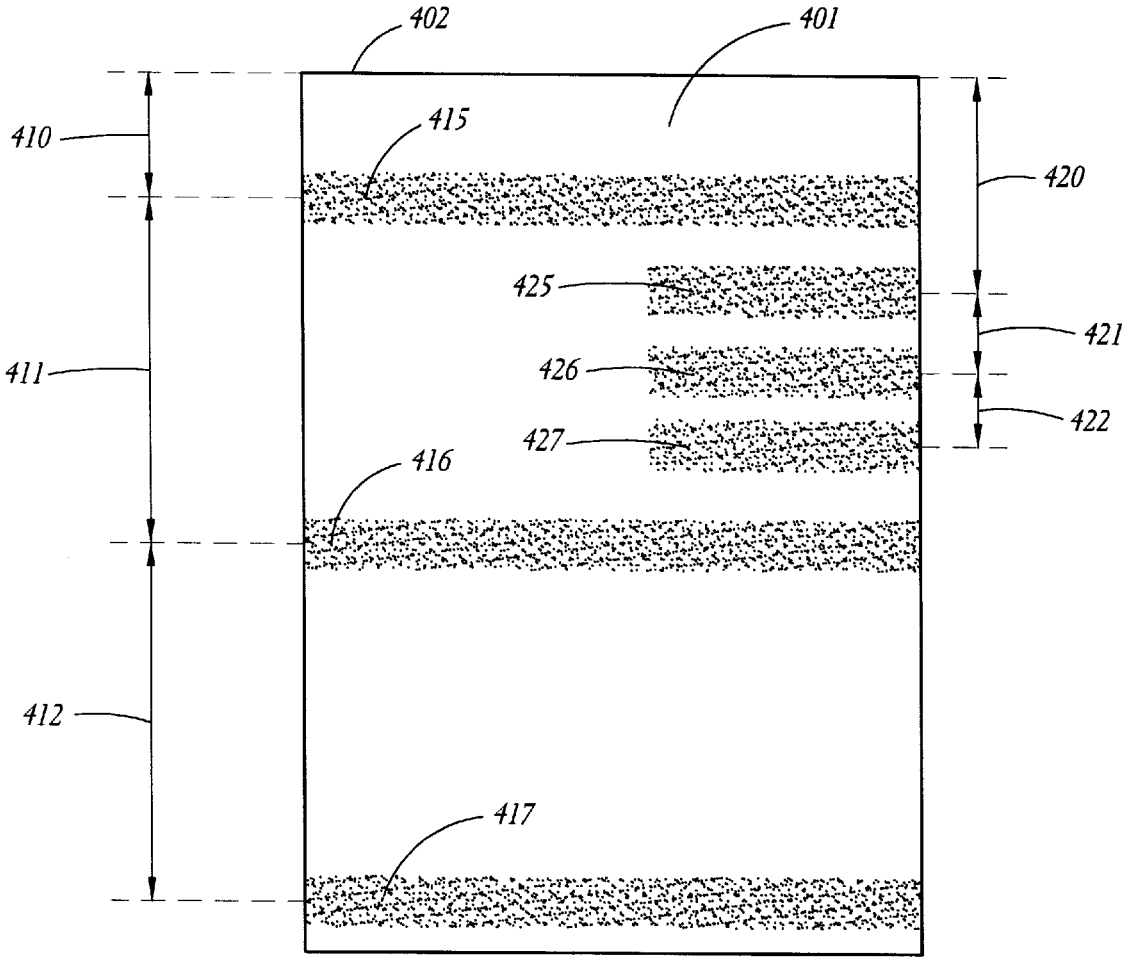
FIG. 4 shows an example of cyclical density variations.

Distance fluctuations can also appear between the developer sleeve 52 and the printhead structure 6. These distance fluctuations usually create cyclical density variations in a direction parallel to the elongated slot. The density variations changes over time in a direction parallel to the direction of movement of the transfer belt 10. FIG. 4 shows an example of these cyclical density variations 415, 416, 417, 425, 426, 427, on a printout 401 where the dark areas illustrate areas where the image density is increased. Other areas can have a decreased image density, but such areas are not shown. Some cyclical density variations 415, 416, 417 appear across the width of the printhead structure which, for example, could be caused by a not completely round developer sleeve. Other cyclical density variations 425, 426, 427 will only appear across a part of the width of the printhead structure which, for example, could be caused by one or both sides of the developer sleeve not being rotated exactly around its rotational axis. Even in print stations using a spacer between the developer sleeve and the printhead structure, and in print stations where the developer sleeve is in direct contact with the printhead structure, this type of print quality degradation can occur if the developer sleeve wobbles and therefore creates a pressure difference between the developer sleeve and printhead structure or spacer.

The cyclical density variations along a direction of movement of the transfer belt can be measured internally by measurement means measuring the density of a test-printout. These measurements can take place between every regular printout, between a predetermined intervall of printouts, e.g. every thousand, on demand, or a suitable combination to thereby directly feed the control unit with the attained density distribution. These test-printouts can, for example, be printed directly onto the transfer belt without any subsequent transfer to an information carrier. The density variations can also, alternatively or in combination, be measured by external measurement means from a print sample, in which case the measured density values have to be fed into the control unit by means of an I/O interface. The characteristic, resolution, and accuracy of the measurement means will influence the measured density variations along the direction of movement of the transfer belt.

According to one aspect of the invention, the measured density variations are utilized to create one or more compensation filter functions, preferably at least one for each print station. This or these filter functions are, according to one aspect of the invention, synchronized with the developer sleeve. The synchronization can either be that the developer sleeve of a print station has a predetermined position in relation to the print station at the start of each print, or the relative position of the developer sleeve is tracked. If the developer has a predetermined position at the start of a print then the compensation filter function or functions of a print station will be the same for each print but if a developer sleeve is tracked then the compensation filter function or functions will adapt accordingly for each print, i.e. the compensation filter function will track the position of the developer sleeve of the print station in question.

According to one aspect of the invention the compensation filter function of each print station is an inverse function, i.e. a mirror image, of the measured image density across a complete image in relation to a desired image density. This two dimensional compensation filter function is subsequently used to adjust, as a function of time or print position along the direction of movement of the transfer belt, the behaviour of individual dots or one or more apertures at a time. To be taken into account, the characteristic, resolution, and accuracy of the measurement means influences the measured density and thus also the compensation filter function. Preferably the filter functions will filter the image data to be printed and the analysis and compensation filter function can preferably work on a anything from segment areas comprising the equivalent of multiple apertures down to a segment size of single dots before rastering is performed.

According to one aspect of the invention an analysis of a measured cyclical density variation or variations along the direction of movement of the transfer belt results in one or more one dimensional compensation filter functions. This or these one dimensional compensation filter functions are subsequently inversely applied two dimensionally to either the bit map, the image data during printing, or the aperture control during printing. If the cyclical density variations 415, 416, 417 appear evenly, i.e. do not differ, in a direction perpendicular to the direction of movement of the transfer belt, i.e. that the cyclical density variations only appear and differ in a direction parallel to the direction of movement of the transfer belt, then only one compensation filter function is needed that only vary in a direction parallel to the direction of movement of the transfer belt. If the density variation varies according to FIG. 4 with both variations that appear along all of the apertures 415, 416, 417 and those that appear only along some of the apertures 425, 426, 427 then at least two compensation filter functions are needed and possibly one or more transition compensation filter functions. This method can be advantageous if there are no or very few variations in a direction perpendicular to the direction of movement of the transfer belt and basically all density variations are in a direction parallel to the direction of movement of the transfer belt, otherwise the use of a two dimensional compensation filter function as described above could be preferable.

According to one aspect of the invention an analysis of a measured cyclical density variation or variations along the direction of movement of the transfer belt results in one or more compensation filter functions that define appearance and extension of the density variations, i.e. the cyclical density variations are identified and parametrized. By analysing the density variations 415, 416, 417, 425, 426, 427 and correlating these with the cyclical rotation of the developer sleeve by determining the distance 410, 420, from the start 402 and the recurrence periods 411, 412, 421, 422 then one or more functions are attained that describe the cyclical density variations and their relationship with the developer sleeve. These functions are then used to either adjust the bitmap for each corresponding print station or the control of the print station to thereby eliminate or reduce the cyclical density variations.

In some embodiments it can be advantageous to low pass filter the output function of the measurement means or the compensation filter function to thereby smear out abrupt changes. Other types of signal processing on either or both functions can be done in dependence on the specific embodiment.

Depending on how the specific adjustment is made, in accordance with the compensation filter function, in dependence on the specific embodiment, only positive adjustments, only negative adjustment, or both positive and negative adjustments can be possible. A zero level, an uncompensated density level, denotes the desired density level and can of course vary. As mentioned the compensation filter function preferably filters the image data, the bit map, but the compensation filter function can also act directly on the control of the print station in question during printout. The adjustments can be made by changing the opening and closing times of individual apertures and/or by changing the voltage potentials of the control electrodes used during opening and closing. The adjustments will enable control, and thus harmonization, of the amount of toner/pigment particles transported through individual apertures during the opening times, thus enabling a harmonization of the perceived image density across the whole image for a predetermined desired image density.

Figure 5:
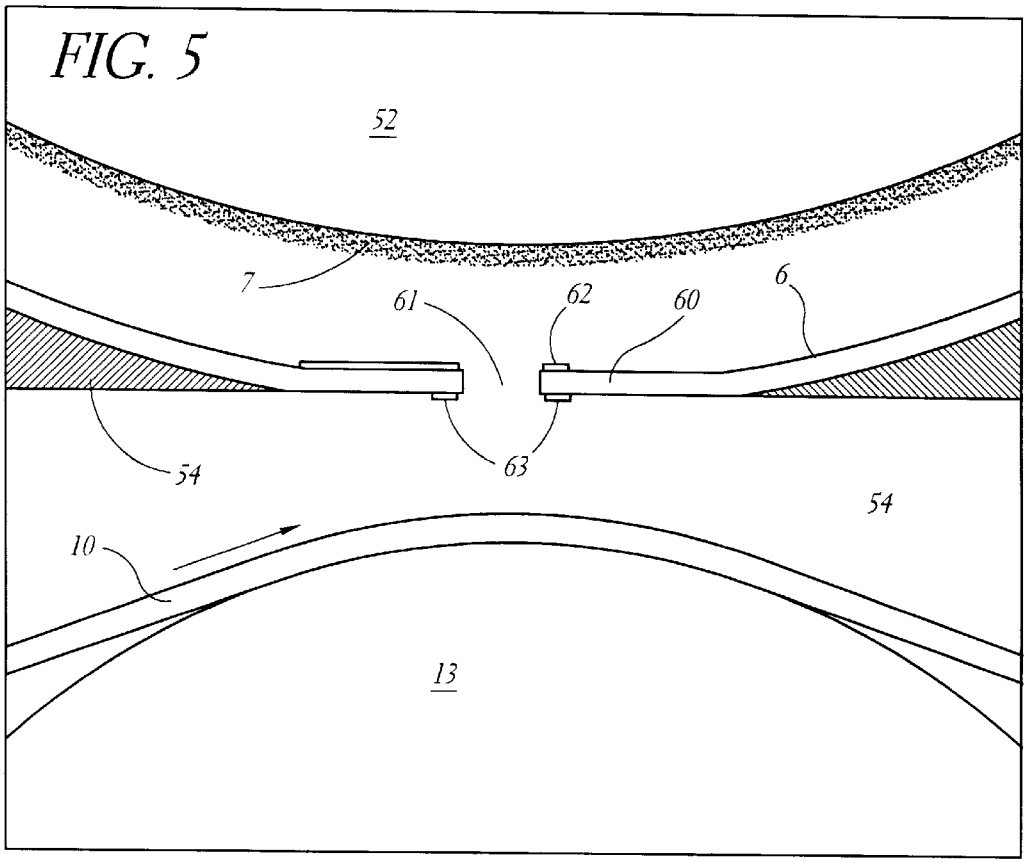
FIG. 5 is an enlargement of FIG. 3 showing the print zone corresponding to a particular print station.

FIG. 5 is an enlargement of the print zone in a print station of, for example, the image recording apparatus shown in FIG. 1. A printhead structure 6 is preferably formed of an electrically insulating substrate layer 60 made of flexible, non-rigid material such as polyamide or the like. The printhead structure 6 is positioned between a peripheral surface of a developer sleeve 52 and a bottom portion of a support device 54. The substrate layer 60 has a top surface facing a toner layer 7 on the peripheral surface of the developer sleeve 52. The substrate layer 60 has a bottom surface facing the bottom portion of the support device 54. Further, the substrate layer 60 has a plurality of apertures 61 arranged through the substrate layer 60 in a part of the substrate layer 60 overlying a elongated slot in the bottom portion of the support device 54. The printhead structure 6 preferably further includes a first printed circuit arranged on the top surface on the substrate layer 60 and a second printed circuit arranged on the bottom surface of the substrate layer 60. The first printed circuit includes a plurality of control electrodes 62, each of which, at least partially, surrounds a corresponding aperture 61 in the substrate layer 60. The second printed circuit preferably includes at least a first and a second set of deflection electrodes 63 spaced around first and second portions of the periphery of the apertures 61 of the substrate layer 60.

The apertures 61 and their surrounding area will under some circumstances need to be cleaned from toner particles which agglomerate there. In some embodiments of the invention the transfer belt 10 advantageously comprises at least one cleaning area for the purpose of cleaning the apertures 61 and the general area of the apertures 61. The cleaning, according to these embodiments, works by the principle of flowing air (or other gas). A pressure difference, compared to the air pressure in the vicinity of the apertures, is created on the side of the transfer belt 10 that is facing away from the apertures 61. The pressure difference is at least created during part of the time when the cleaning area is in the vicinity of the apertures 61 of the print station in question during the transfer belt's 10 movement. The pressure difference can either be an over pressure, a suction pressure or a sequential combination of both, i.e. the cleaning is performed by either blowing, suction, blowing first then suction, suction first then blowing, or some other sequential combination of suction and blowing. The pressure difference is transferred across the transfer belt 10 by means of the cleaning area comprising at least one slot/hole through the transfer belt 10. The cleaning area preferably comprises at least one row of slots, and more specifically two to eight interlaced rows of slots. The slots can advantageously be in the order of 3 to 5 mm across. The pressure difference appears on the holding element 13 side of the transfer belt 10 through a transfer passage in the holding element 13. The transfer passage can advantageously suitably extend transversally across the printhead structure as an elongated slot with a width, in the direction of the transfer belt 10 movement, that is equal to or greater than the minimum distance between the printhead structure 6 and the transfer belt 10. In some embodiments it can be advantageous to have a controllable passage which can open and close access of the pressure difference to the transfer passage. Thereby a suction pressure will not increase the transfer belt's friction on the holding element 13 more than necessary. The controllable passage will preferably open and close in synchronization with the movement of the transfer belt 10 to thereby coincide its openings with the passage of the cleaning area of the transfer belt 10. The means for creating the pressure difference is also not shown and can suitably be a fan, bellows, a piston, or some other suitable means for creating a pressure difference. In some embodiments according to the invention the transfer passage is substantially located symmetrically in relation to the apertures. In other embodiments according to the invention the transfer passage is shifted in relation to the direction of movement of the transfer belt 10.

Figure 6B:
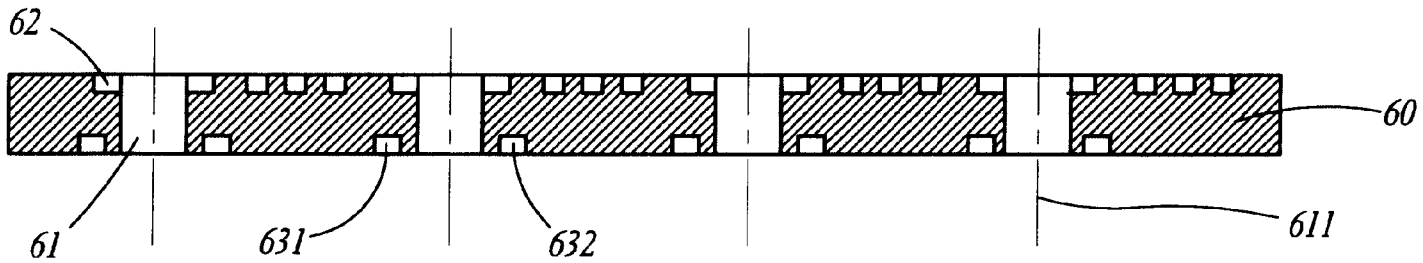
FIG. 6*b* is a schematic section view along the section line I—I through the printhead structure shown in FIG. 5*a,*
Figure 6C:
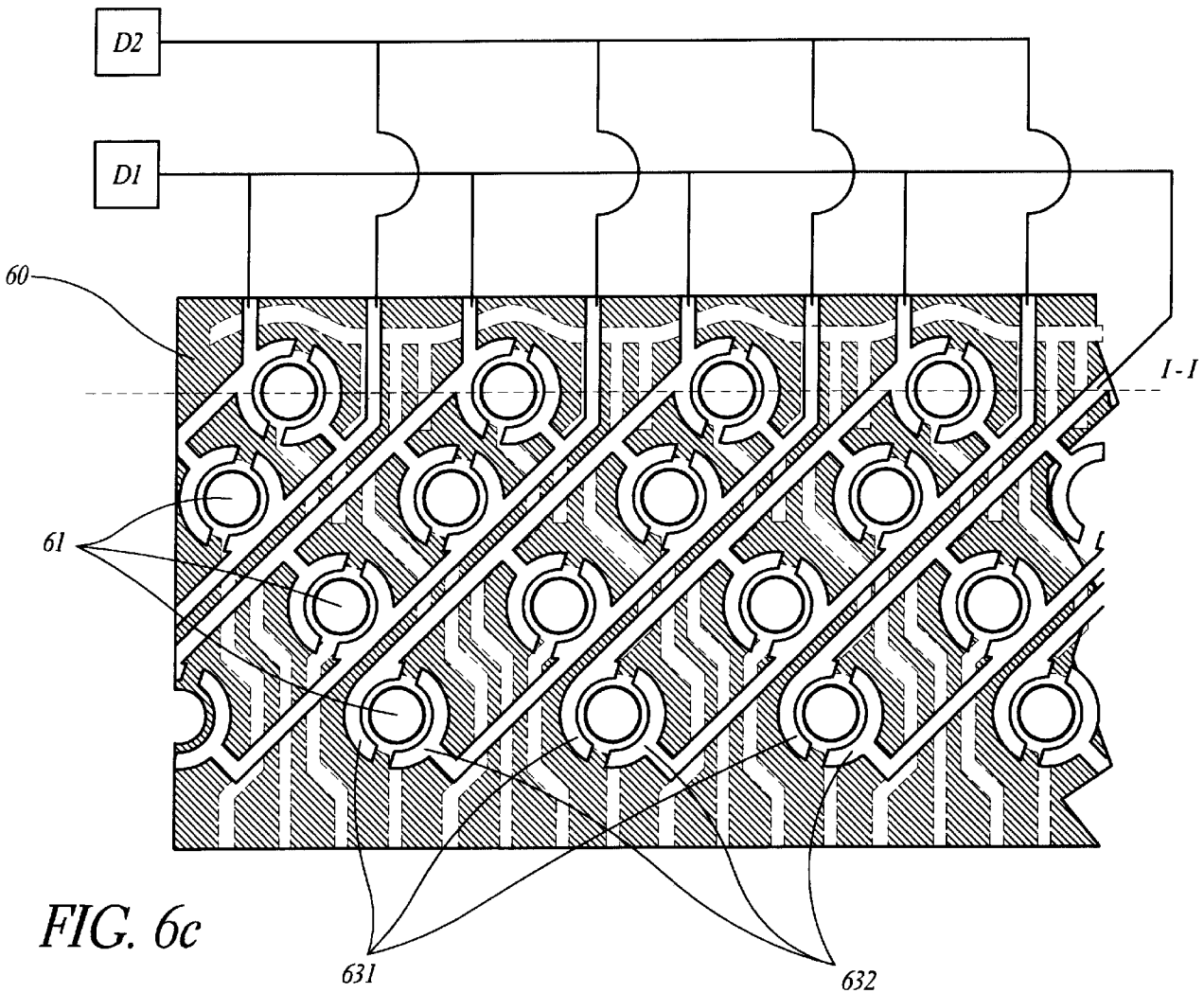
FIG. 6*c* is a schematic plan view of the bottom side of the printhead structure shown in FIG. 5*a,*

Although, a printhead structure 6 can take on various embodiments without departing from the scope of the present invention, a preferred embodiment of the printhead structure will be described hereinafter with reference to FIGS. 6*a*, 6*b* and 6*c*. A plurality of apertures 61 are arranged through the substrate layer 60 in several aperture rows extending transversally across the width of the print zone, preferably at a substantially right angle to the motion of the transfer belt. The apertures 61 preferably have a circular cross section with a central axis 611 extending perpendicularly to the substrate layer 60 and suitably a diameter in the order of 100 $\mu$m to 160 $\mu$m. Each aperture 61 is surrounded by a control electrode 62 having a ring-shaped part circumscribing the periphery of the aperture 61, with a symmetry axis coinciding with the central axis 611 of the aperture 61 and an inner diameter which is equal or sensibly larger than the aperture diameter. Each control electrode 62 is connected to a control voltage source (IC driver) through a connector 621. As apparent in FIG. 6*a*, the printhead structure further preferably includes guard electrodes 64, preferably arranged on the top surface of the substrate layer 60 and connected to a guard potential (Vguard) aimed to, among other things, decrease the influence on the toner layer and to electrically shield the control electrodes 62 from one another, thereby preventing undesired interaction between the electrostatic fields produced by two adjacent control electrodes 62. Each aperture 61 is related to a first deflection electrode 631 and a second deflection electrode 632 spaced around a first and a second segment of the periphery of the aperture 61, respectively. The deflection electrodes 631, 632 are preferably semicircular or crescent-shaped and disposed symmetrically on each side of a deflection axis extending diametrically across the aperture at a predetermined deflection angle to the motion of the transfer belt, such that the deflection electrodes substantially border on a first and a second half of the circumference of their corresponding aperture 61, respectively. All first and second deflection electrodes 631, 632 are connected to a first and a second deflection voltage source D1, D2, respectively.

As mentioned previously, different apertures behave differently. The apertures behave differently possibly partly due to the manufacturing of the printhead structure causing slightly different apertures to be made and possibly partly due to how the printhead structure is mounted. The centricity, size, and directivity of an aperture will influence its behaviour. The centricity of an aperture, i.e. how an aperture is centered in relation to its corresponding control electrode, will influence the amount of pigment particles the aperture will transport, given that other parameters are the same, because it will influence the efficiency of the control electrode. The size of an aperture will also vary the amount of transported pigment particles, given that other parameters are the same. These two irregularities will most probably be caused by irregularities in manufacturing while the directivity of an aperture, i.e. the directivity of an imagined center line through the aperture in relation to the pigment particle source and the back electrode, can be influenced by manufacturing and/or mounting. Other physical properties of the apertures and the printhead structure in general can of course also influence the behaviour of the apertures.

Figure 7A:
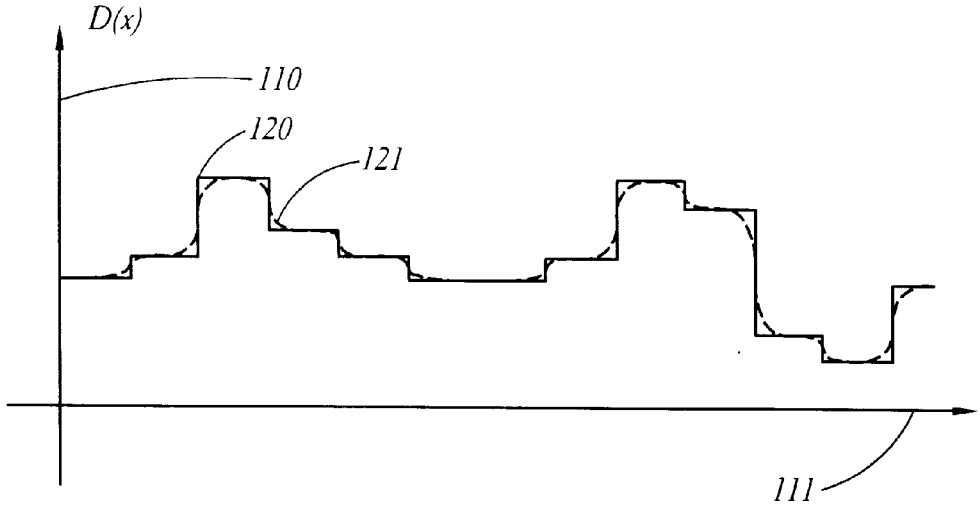
FIG. 7*a* illustrates a diagram of a measured or perceived density across the apertures.

The diagram according to FIG. 7*a*, where the Y-axis 110 indicates measured/perceived density D(x) for the same printed density and where the X-axis 111 indicates the distance across the printhead structure along the apertures, shows an example of how a printed density 120, 121 can vary due to the difference in behaviour of the individual apertures. FIG. 7*a* can equally well show the density distribution 120, 121 across a few apertures where the variations shown indicate individual apertures or FIG. 7*a* could show the density distribution 121 across the whole printhead structure along all the apertures.

The density distribution can be measured internally by measurement means between every printout, between a predetermined intervall of printouts, e.g. every thousand, on demand, or a suitable combination to thereby directly feed the control unit with the density distribution. The density can also, alternatively or in combination, be measured by external measurement means from a print sample, in which case the measured values have to be fed into the control unit by means of an I/O interface. The characteristic, resolution, and accuracy of the measurement means will influence the measured density distribution and give different distributions.

Figure 7B:
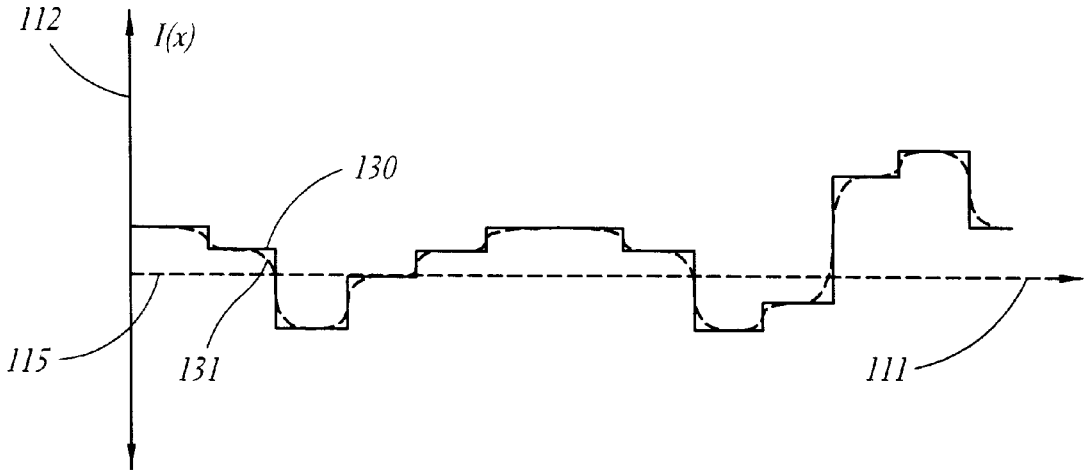
FIG. 7*b* illustrates a diagram of a compensation function.

According to one aspect of the invention, the measured density is utilized to create a compensation function. FIG. 7*b* shows a diagram of an example of a compensation function I(x) 130, 131 in view of a measured density according to FIG. 7*a*. The Y-axis 112 shows the level of the compensation function I(x) and the X-axis 111 indicates the distance across the printhead structure along the apertures. A zero level 115, or rather a level where no compensation is performed, will vary depending on the specific embodiment. According to one aspect of the invention the compensation function I(x) 130, 131 is an inverse function, i.e. a mirror image, of the measured density. This compensation is subsequently used to adjust the behaviour of individual or more apertures at a time. As mentioned previously, the characteristic, resolution, and accuracy of the measurement means influences the measured density and thus also the compensation, this is shown in the FIGS. 7*a* and 7*b* by the filled 120, 130 and dotted lines 121, 131. However, it can also in some embodiments be advantageous to low pass filter the output function of the measurement means or the compensation function to thereby smear out abrubt changes. Other types of signal processing on either or both functions can be done in dependence on the specific embodiment.

Depending on how the specific adjustment is made, in accordance with the compensation function, in dependence on the specific embodiment, only positive adjustments, only negative adjustment, or as shown in the figure, both positive and negative adjustments can be possible. The zero level 115, the uncompensated density level, denotes the desired density level and can of course vary. The adjustments can be made by changing the opening and closing times of individual apertures and/or by changing the voltage potentials of the control electrodes used during opening and closing. The adjustments will enable control, and thus harmonization, of the amount of toner/pigment particles transported through individual apertures during the opening times, thus enabling a harmonization of the perceived image density across the apertures for a predetermined desired image density.

As mentioned previously, an uneven supply of pigment particles to the apertures may arise. If different apertures have a different amount of pigment particles available, then the amount of toner/pigment particles transported, and thus printed density, through these apertures will be different for the same desired density. One possible reason for an uneven availability of pigment particles to different apertures can be that the apertures commonly are arranged in two or more rows.

Figure 8:
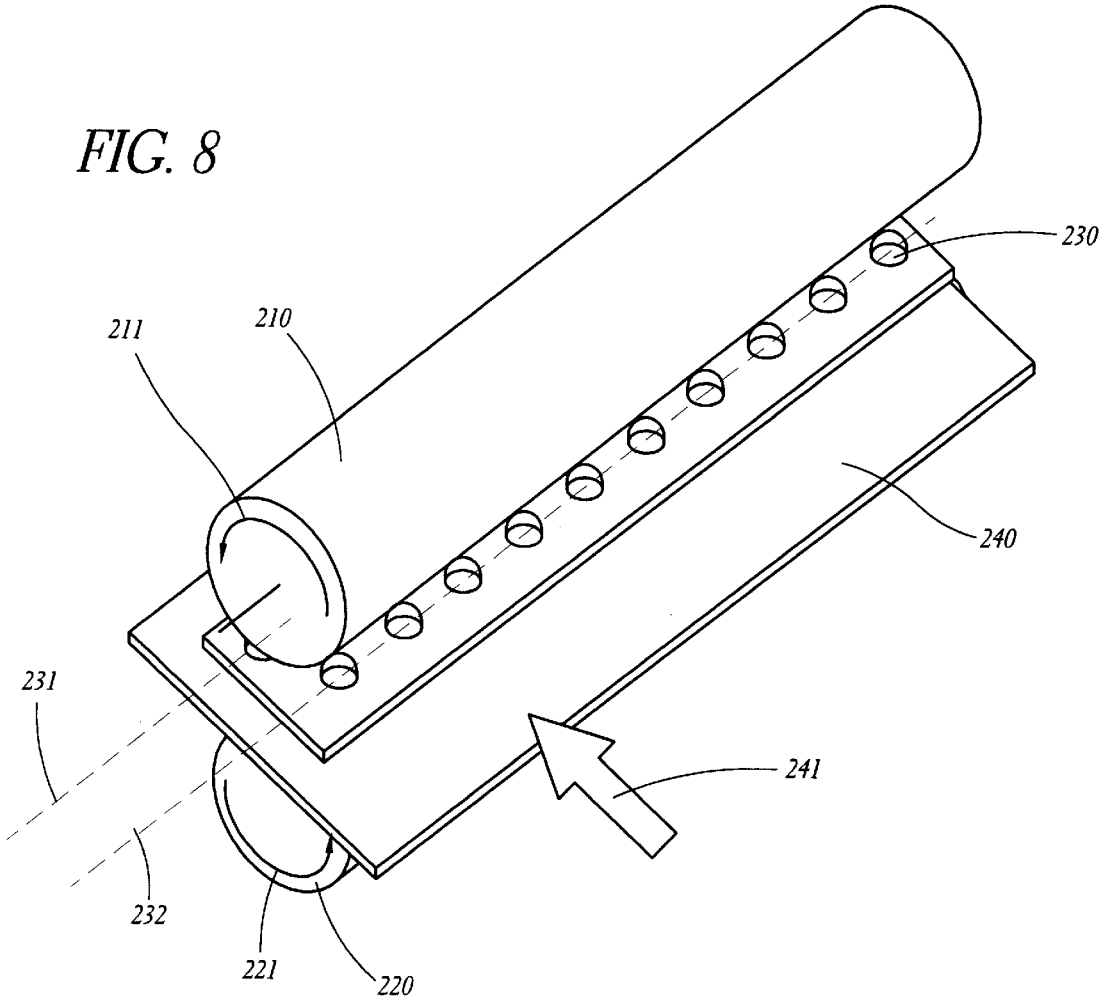
FIG. 8 is a schematic view of part of a printhead structure and a pigment particle source.

FIG. 8 shows a very rough schematic of a printhead structure with two rows 231, 232 of apertures 230, a pigment particle source 210 having a first rotational direction 211, a back electrode 220 with a possible second rotational direction 221, and an image receiving member 240 such as an intermediate image receiving member, a transfer belt, or information carrier, having a directional movement 241.

The row 231 of apertures that the pigment particle source 210 reaches first, so to speak, will have a full nominal supply of pigment particles available. The second 232 and further rows will have less pigment particles available if there has been some printing done by the first row 231. This is because the pigment particle pick-up area of an aperture is somewhat larger than the aperture which causes the first row 231 of apertures to "steal" pigment particles from the second 232 and further rows'supply.

The control unit of the device preferably controls the amount of pigment particles delivered through the apertures. In one embodiment the control unit controls the control electrodes of the apertures so that the apertures of the first row will pull pigment particles for a shorter period of time or at a lesser rate than the apertures of the second and further rows will for the same desired density. The control unit accomplishes this by changing the opening and closing times of the apertures, changing the voltage potentials of the control electrodes during opening and closing, and/or by changing the electrical field created by i.a. the back electrode for the transportation of pigment particles.

In another embodiment, alone or in combination with previously described features, the control unit preferably controls the control electrodes of the apertures such that when a feature having an edge with the same density as the feature as a whole, i.e. there is a density change in relation to the surroundings, is to be printed, the dots printed on the edge receive mainly the same amount of pigment particles as the dots printed within the feature. A feature will mean a change in density from high to low and from low to high or from low to high and from high to low depending on the density of the feature and the density of the surroundings. Thus, there will be a change in the consumption and therefore also the amount of available pigment particles and this will vary from the edge of a feature to a steady state within the feature. To harmonize the perceived density of the feature the control unit will control the control electrodes of the apertures such that all the dots of the feature with the same desired dot density mainly receive the same amount of pigment particles. This is accomplished by letting apertures, when the apertures prints dots of an edge of a feature, pull pigment particles for a shorter period of time or at a lesser rate than when the apertures prints dots within the feature or vice versa in dependence on the desired density of the feature and the desired density of the surroundings. The control unit accomplishes this by changing the opening and closing times of the apertures and/or by changing the voltage potentials of the control electrodes during opening and closing.

The control unit of the device preferably continuously keeps track of the amount of pigment particles each aperture has available to thereby be able to control the amount of pigment particles that are fed through the apertures. By being able to control the amount of pigment particles that are fed through the apertures, a high degree of accuracy is possible of the attained printed density. By knowing the pick-up area of each aperture, the renewal rate of pigment particles, and the past history, i.e. has there been much black printed leaving very little toner left or has no printing been done meaning that there is plenty of pigment particles, the control unit preferably determines the amount of pigment particles that individual or possibly group of apertures have available for printing. This information is preferably used by the control unit to control the control electrodes such that an appropriate amount of pigment particles are transported through an aperture in question to thereby a desired printed density. If only a small amount of pigment particles are available then the aperture has pull pigment particles harder and/or longer than if a large amount of pigment particles are available. The control unit accomplishes this by either changing the opening and closing times of the aperture and/or by changing the control voltages of the control electrode of the aperture during opening and closing.

Figure 9:
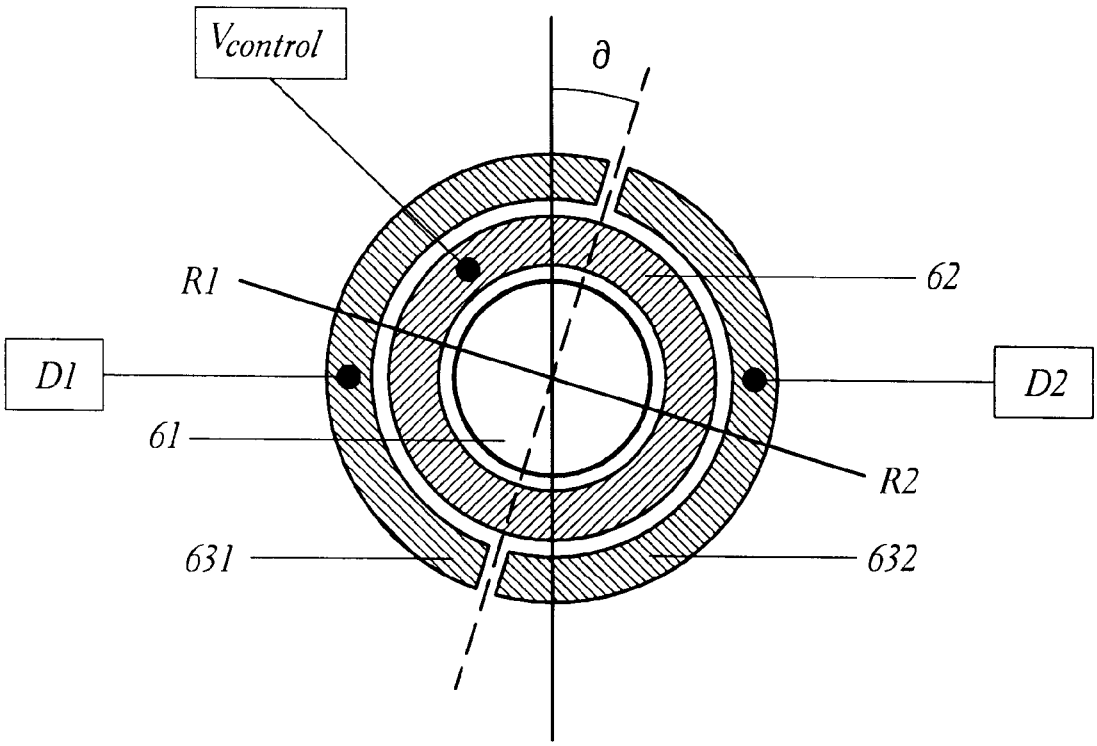
FIG. 9 is a schematic view of a single aperture and its corresponding control electrode and deflection electrodes.

FIG. 9 is a schematic view of a single aperture 61 and its corresponding control electrode 62 and deflection electrodes 631, 632. Toner particles are deflected in a first deflection direction R1 when D1<D2, and an opposite direction R2 when D1>D2. The deflection angle δ is chosen to compensate for the motion of the transfer belt 10 during the print cycle, in order to be able to obtain two or more transversally aligned dots.

Figure 10A:
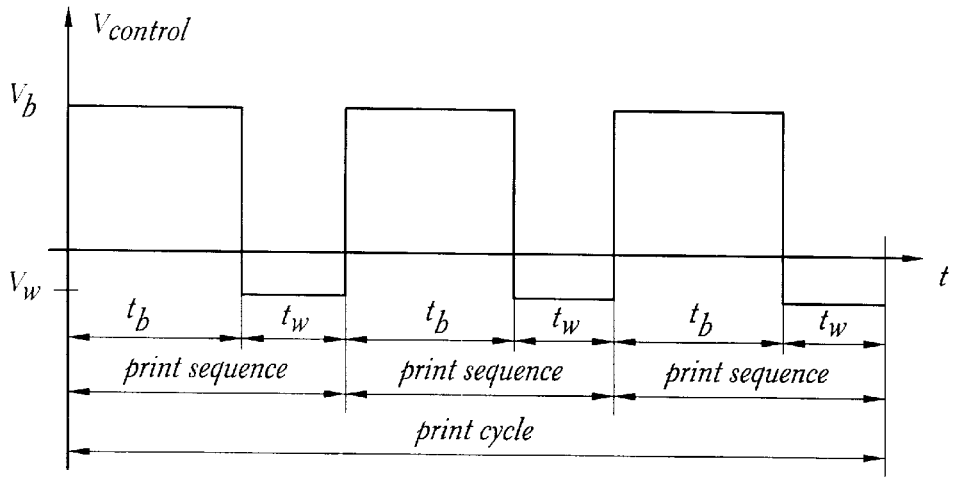
FIG. 10*a* illustrates a control voltage signal as a function of time during a print cycle having three subsequent development periods.
Figure 10B:
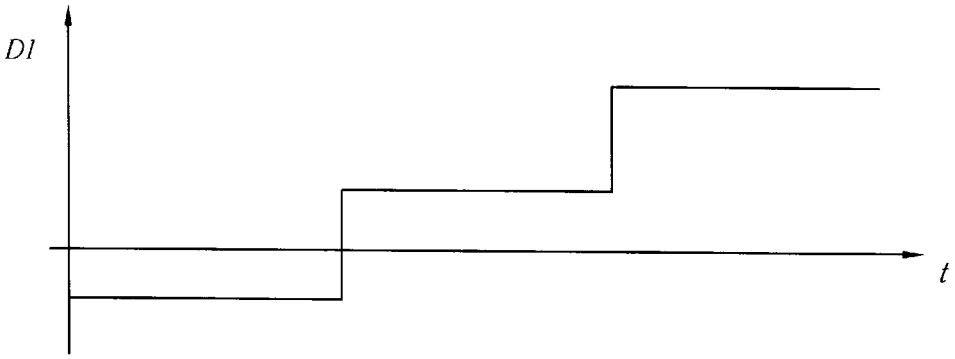
FIG. 10*b* illustrates a first deflection voltage signal as a function of time during a print cycle having three subsequent development periods
Figure 10C:
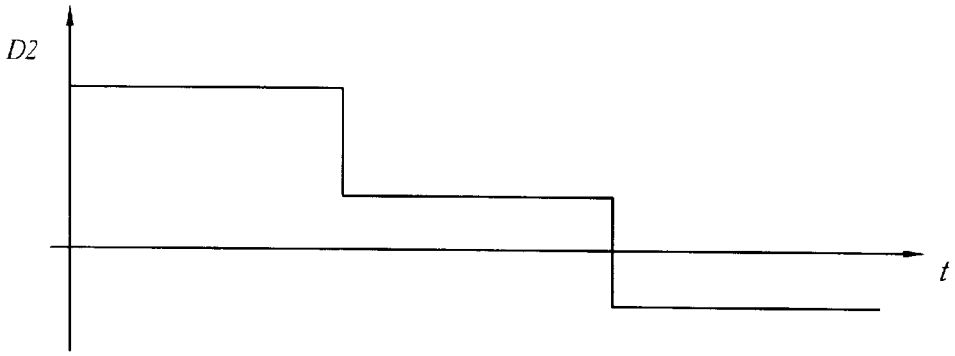
FIG. 10*c* illustrates a second deflection voltage signal as a function of time during a print cycle having three subsequent development periods

A preferred embodiment of a dot deflection control function is illustrated in FIGS. 10*a*, 10*b* and 10*c* respectively showing the control voltage signal ($V_{control}$), a first deflection voltage D1 and a second deflection voltage D2, as a function of time during a single print cycle. According to some embodiments of the invention and as illustrated in the figure, printing is performed in print cycles having three subsequent print sequences with corresponding development periods for addressing three different dot locations through each aperture. In other embodiments each print cycle can suitably have fewer or more addressable dot locations for each aperture. In still further embodiments each print cycle has a controllable number of addressable dot locations for each aperture.

During the whole print cycle an electric background field is produced between a first potential on the surface of the developer sleeve and a second potential on the back electrode, to enable the transport of toner particles between the developer sleeve and the transfer belt. During each development period, control voltages are applied to the control electrodes to produce a pattern of electrostatic control fields which due to control in accordance with the image information, selectively open or close the apertures by influencing the electric background field, thereby enhancing or inhibiting the transport of toner through the printhead structure. The toner particles allowed to pass through the opened apertures are then transported toward their intended dot location along a trajectory which is determined by the deflection mode.

The examples of control function shown in FIGS. 10*a*, 10*b* and 10*c* illustrates a control function wherein the toner particles have negative polarity charge. As is apparent from FIG. 10*a*, a print cycle comprises three development periods $t_b$, each followed by a recovering period $t_w$ during which new toner is supplied to the print zone. The control voltage pulse ($V_{control}$) can be amplitude and/or pulse width modulated, to allow the intended amount of toner particles to be transported through the aperture. For instance, the amplitude of the control voltage varies between a non-print level $V_W$ of approximately −50V and a print level $V_b$ in the order of +350V, corresponding to full density dots. Similarly, the pulse width can be varied from 0 to $t_b$.

The control of the position of a dot location can be increased to thereby enable an apparent increase of the print resolution. A method of achieving this is to individually control the timing of each developer period, i.e. individually control the timing of the opening and closing of the apertures. By individually controlling the timing for each developer period for each aperture, each dot location can be repositioned in a direction which is mainly parallell to the direction of travel of the image receiving member, information carrier, or transfer belt. Thus individual dot positions can be moved/adjusted forward or backward, i.e. in a direction parallel to the direction of travel of the information carrier, by time displacing the opening and closing of the apertures.

As apparent from FIGS. 10*b* and 10*c*, the amplitude difference between D1 and D2 is sequentially modified for providing three different toner trajectories, i.e. dot positions, during each print cycle. The amplitudes of D1 and D2 are modulated to apply converging forces on the toner to obtain smaller dots. Utilizing this method enables, for example, 60 μm dots to be obtained utilizing 160 μm apertures. Suitably the size of the dots are adjusted in accordance with the dot density (dpi) and thus also dynamically with the number of dot locations each aperture is to address.

An additional, or another, method/part method of increasing the apparent print resolution is to control the size of the individual dots not only in view of the dot density but also according to the image which is to be printed. Thus by being able to increase or decrease the size of individual dots, in dependence upon the image which is to be printed, especially edges can be improved, giving an improved image print quality. This can be used on its own or in combination with the improved dot location control.

Figure 11A:
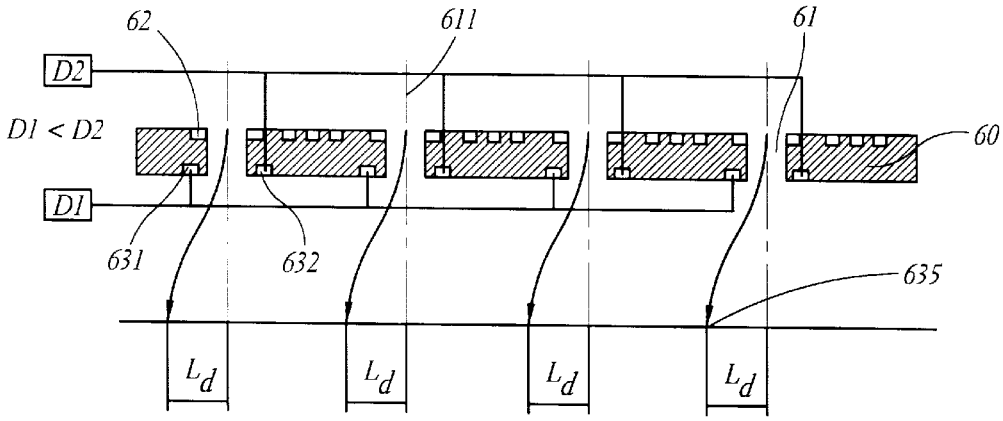
FIG. 11*a* illustrates the transport trajectory of toner particles through the printhead structure shown in FIGS. 6*a, b, c* according to a first deflection mode wherein D1>D2.
Figure 11B:
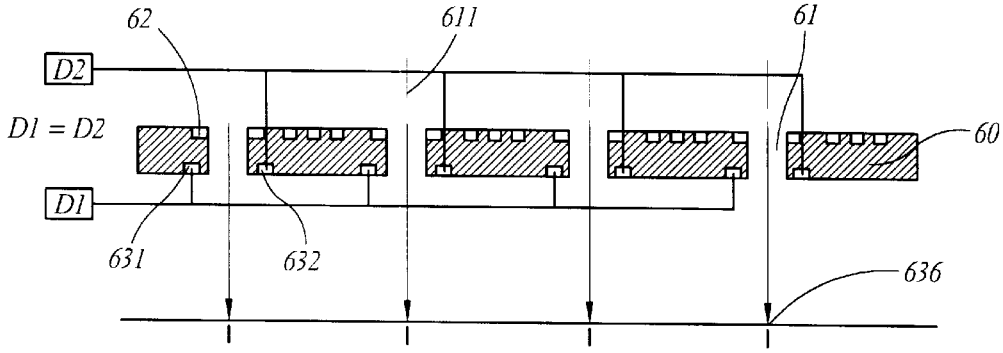
FIG. 11*b* illustrates the transport trajectory of toner particles through the printhead structure shown in FIGS. 6*a, b, c*, according to a second deflection mode wherein D1=D2.
Figure 11C:
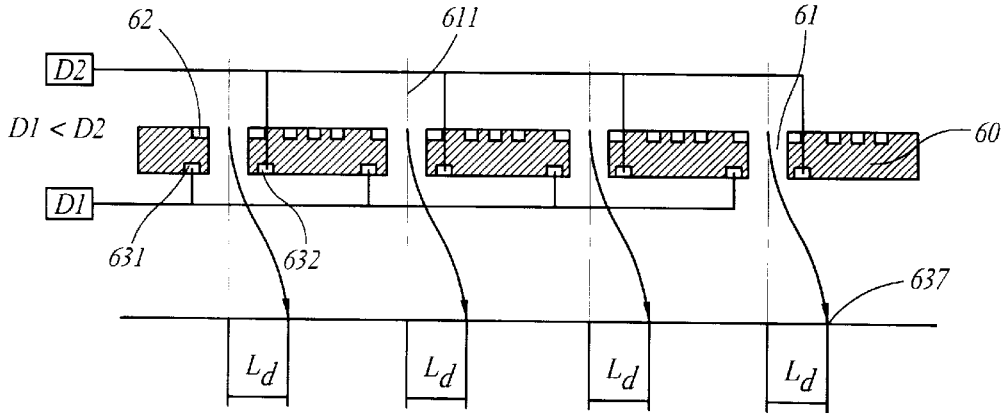
FIG. 11*c* illustrates the transport trajectory of toner particles through the printhead structure shown in FIGS. 6*a, b, c*, according to a third deflection mode wherein D1<D2.

FIGS. 11*a*, 11*b* and 11*c* illustrate the toner trajectories in three subsequent deflection modes. The FIGS. 11*a*, 11*b* and 11*c* illustrate a cross section of a substrate layer 60 with apertures 61 with corresponding control electrodes 62. Also illustrated are deflection voltages D1 and D2 that are connected to respective deflection electrodes 631, 632. During a first development period illustrated in FIG. 11*a*, the modulated stream of toner particles is deflected to the left by producing a first amplitude difference (D1>D2) between both deflection voltages. The amplitude difference is adjusted to address dot locations 635 located at a deflection length $L_d$ to the left of the central axes 611 of the apertures 61. During a second development period illustrated in FIG. 11*b*, the deflection voltages have equal amplitudes (D1=D2) to address undeflected dot locations 636 coinciding with the central axes 611 of the apertures 61. During a third development period illustrated in FIG. 11*c*, the modulated stream of toner particles is deflected to the right by producing a second amplitude difference (D1<D2) between both deflection voltages. The amplitude difference is adjusted to address dot locations 637 located at a deflection length $L_d$ to the right of the central axes 611 of the apertures 61. As is apparent from the FIGS. 11*a–c*, the toner particles in question are negatively charged.

The control of the position of a dot location can be increased to thereby enable an apparent increase of the print resolution. A method of achieving this is to divide a print sequence into different parts with different deflection voltages by time multiplexing, i.e. during a first part time dots with normal deflection are printed and during a second or more part time(s) dots with a modified deflection are printed. Another method of achieving this is to individually control the deflection of each print sequence, i.e. individually control the deflection voltages D1 and D2 of the deflection electrodes of each aperture to thereby individually adjust $L_d$ and possibly introduce a deflection of a center dot. By individually controlling the deflection voltages during each print sequence for each aperture, each dot location can be repositioned in a direction which is mainly perpendicular to the direction of travel of the image receiving member, information carrier, or transfer belt. Thus individual dot positions can be moved/adjusted leftward or rightward, i.e. in a direction perpendicular to the direction of travel of the information carrier, by adjusting the deflection voltages of the apertures.

Figure 12:
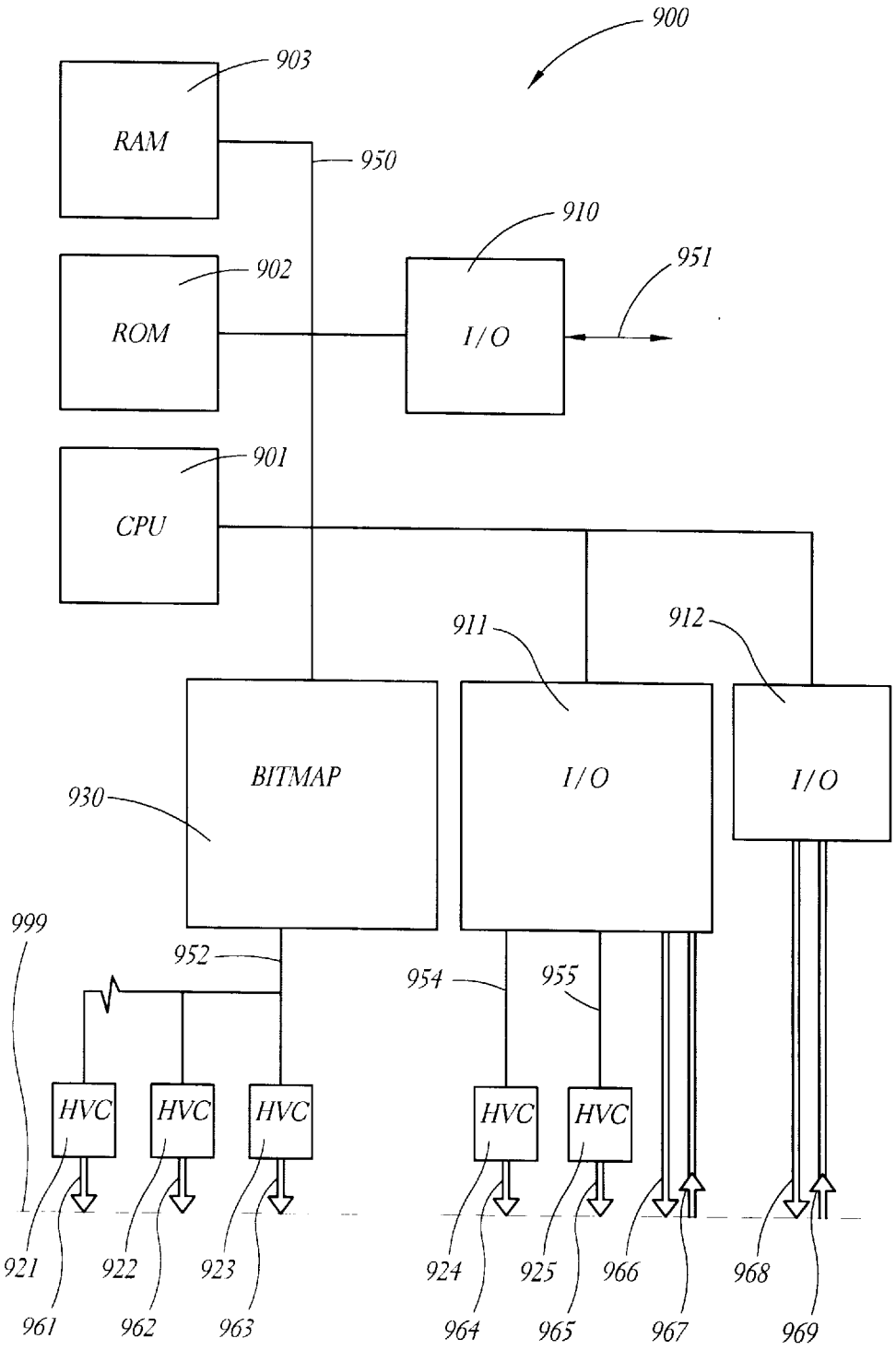
FIG. 12 illustrates a control unit.

The control functions of a printer according to the invention is handled by a control unit which is schematically illustrated in FIG. 12. The illustration of the control unit 900 is merely to give an example of one possible embodiment of the control unit 900. All the different parts may be separate as illustrated or more or less integrated. The memories 902, 903, 930 may be of an arbitrary type which will suit the embodiment in question. The control unit 900 comprises a computing part which comprises a CPU 901, program memory ROM 902, working memory RAM 903, a user I/O interface 910 through which a user will communicate 951 with the printer for downloading of commands and images to be printed, and a bus system 950 for interconnection and communication between the different parts of the control unit 900. The control unit 900 also suitably comprises a bitmap 930 for storage of the image to be printed and one or more I/O interfaces 911, 912 for control and monitoring of the printer. Further, if necessary, one or more power - high voltage drivers 921, 922, 923, 924, 925 are connected to the hardware of the printer illustrated by an interface line 999.

The one or more I/0 interfaces 911, 912 for control and monitoring of the printer can logically be divided into one simple I/O interface 912 for on/off control and monitoring and one advanced I/O interface 911 for multilevel control and monitoring, speed control, and analog measurements. Typically the simple I/O interface 912 handles keyboard input 969 and feedback output 968, control of simple motors and indicators, monitoring of different switches and other feedback means. Typically the advanced I/O interface 911 will control 954, 955 the deflection voltages 964 and guard voltages 965 via high voltage drivers 924, 925. The advanced I/O interface 911 will typically also speed control 966 one or more motors with a control loop feedback 967.

A user, e.g. a personal computer, will download, through the user I/O interface 910, commands and images 951 to be printed. The CPU 901 will interpret the commands under control of its programs and typically load the images to be printed into the bitmap 930. The bitmap 930 will preferably comprise at least two logical bitmaps, one which can be printed from and one which can be used for download of the next image to be printed. The functions of the preferably at least two logical bitmaps will continuously switch when their previous function is finished.

In a preferred embodiment the bitmap 930 will serially 952 load a plurality of high voltage drive controllers 921, 922, 923 with the image information to be printed. The number of high voltage drive controllers 921, 922, 923 that are necessary will, for example, depend on the resolution and the number of apertures, i.e. control electrodes, each controller 921, 922, 923 will handle. The high voltage drive controllers 921, 922, 923 will convert the image information they receive to signals 961, 962, 963 with the proper voltage levels required by the control electrodes of the printer.

Figure 13:
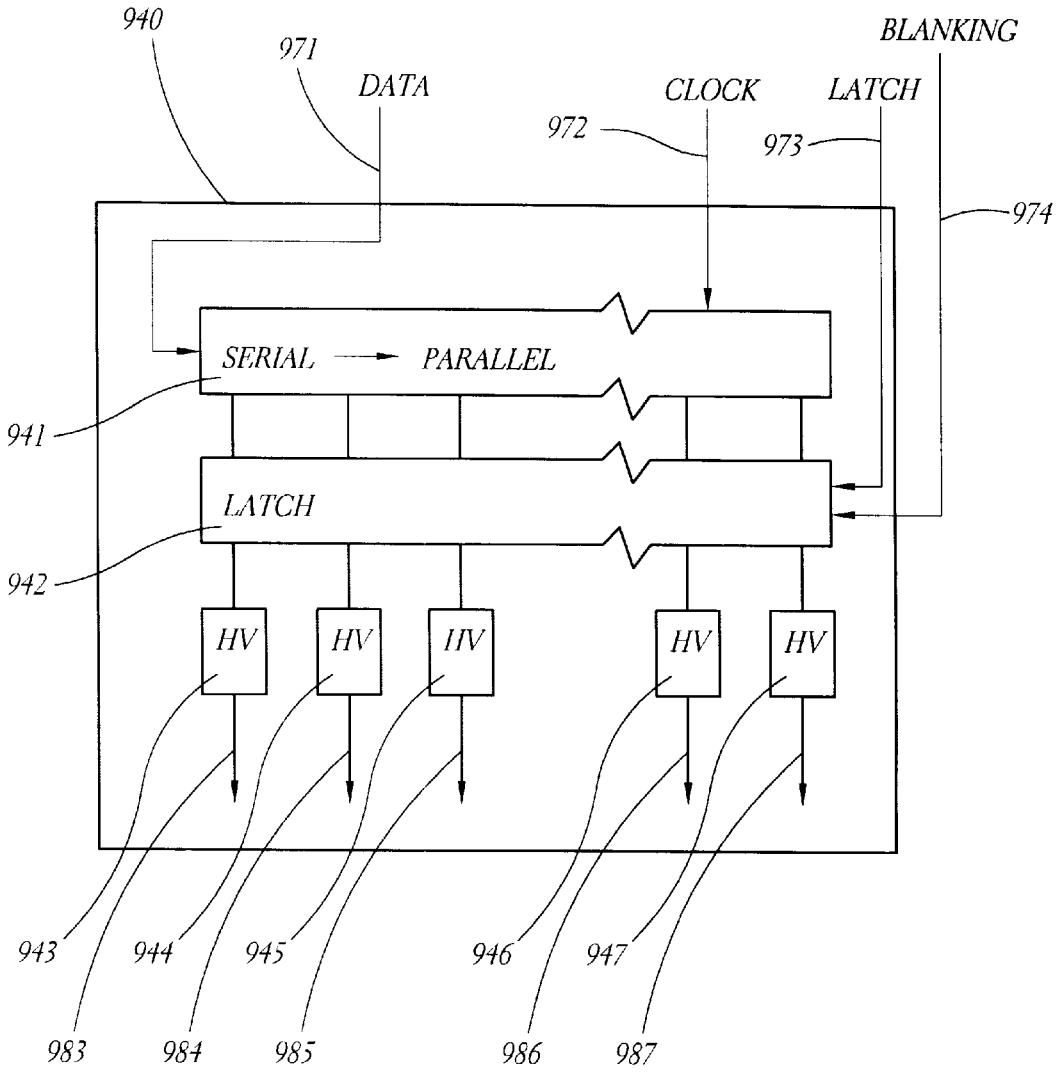
FIG. 13 illustrates a high voltage control electrode driver.

FIG. 13 illustrates one possible schematic of a high voltage drive controller 940. The image information is received serially via a data input 971. The image information is clocked 972 into a serial to parallel register 941. When the serial to parallel register 941 is full the image information is latched 973 into a latch 942 at an appropriate time, thus enabling new image information to be clocked into the serial to parallel register. The controller preferably comprises high voltage drivers 943, 944, 945, 946, 947 for conversion of the image data in the latch to signals 983, 984, 985, 986, 987 with the appropriate voltage levels required by the control electrodes of the apertures. The high voltage drive controller can also suitably comprise a blanking input 974 to enable a higher degree of control of the outputs 983, 984, 985, 986, 987 to the control electrodes.

The invention is not limited to the embodiments described above but may be varied within the scope of the appended patent claims.

What is claimed is:

1. A direct electrostatic printing device comprising at least two pigment particle sources providing pigment particles, a voltage source, at least one printhead structure, and a control unit, the at least one printhead structure and an image receiving member moving relative to each other during printing, the image receiving member having a first face and a second face, the at least one printhead structure being placed in between the at least two pigment particle sources and the first face of the image receiving member, the voltage source being connected to the pigment particle sources and a back electrode to create an electrical field for transport of pigment particles from the pigment particle sources toward the first face of the image receiving member, the at least one printhead structure including control electrodes connected to the control unit to selectively open or close apertures through the at least one printhead structure to permit or restrict the transport of pigment particles to enable the formation of a multiple pigment image on the first face of the image receiving member, the apertures being aligned in at least one row per pigment particle source in a direction substantially perpendicular to the relative movement between the image receiving member and the at least one printhead structure, each pigment particle source being associated with a part bit map in the control unit for formation of a part pigment image, the control unit being arranged to virtually adjust at least one part bit map positionally to align the part pigment images with each other to enable the formation of a correctly aligned multiple pigment image even though the at least one row of apertures related to one particle source and the at least one row of apertures related to the at least one other particle source are mechanically misaligned.

2. A direct electrostatic printing device according to claim 1, wherein the at least one row of apertures related to one pigment particle source can print at least one additional dot in relation to the corresponding part bit map.

3. A direct electrostatic printing device according to claim 1, wherein the at least one row of apertures corresponding to the bitmap which the control unit is arranged to virtually adjust may print at least one additional dot in relation to the corresponding part bit map.

4. A direct electrostatic printing device according to claim 1, wherein the control unit determines the required virtual positional adjustment of at least one part pigment image.

5. A direct electrostatic printing device according to claims 1, wherein the control unit in relation to one or more reference functions determines a required virtual positional adjustment of the at least one part pigment image.

6. A direct electrostatic printing device according to claim 5, wherein the reference function is associated with a measurement of a test pattern.

7. A direct electrostatic printing device according to claim 6, wherein the measurement is an optical measurement of at least one printed test pattern.

8. A direct electrostatic printing device according to claim 6, wherein the image receiving member is a transfer belt positioned at a predetermined distance from the printhead structure, the transfer belt being substantially of uniform thickness, whereby a pigment image is subsequently transferred to an information carrier, and wherein the measurement is a measurement of at least one permanent test pattern on the transfer belt.

9. A direct electrostatic printing device according to claim 8, wherein the measurement of at least one permanent test pattern on the transfer belt is performed in a non-optical manner.

10. A direct electrostatic printing device according to claim 9, wherein the measurement of at least one permanent test pattern on the transfer belt is performed magnetically.

11. A direct electrostatic printing device according to claim 9, wherein the measurement of at least one permanent test pattern on the transfer belt is performed capacitively.

12. A direct electrostatic printing device according to claim 8, wherein the measurement of at least one permanent test pattern on the transfer belt is performed in an optical manner.

13. A direct electrostatic printing device according to claim 7, wherein the electrostatic printing device further comprises at least one optical measurement means for the optical measurement.

14. A direct electrostatic printing device according to claim 7, further comprising means for inputting values from the optical measurement.

15. A direct electrostatic printing device according to claim 1, including at least two pigment particle sources with corresponding control electrodes and apertures on and in a corresponding printhead structure.

16. A direct electrostatic printing device according to claim 1, wherein the electrostatic printing device prints color images and comprises four pigment particle sources.

17. A direct electrostatic printing device according to claim 1, comprising four pigment particle sources with corresponding control electrodes and apertures on and in at least one printhead structure.

18. A direct electrostatic printing device according to claim 1, wherein the printhead structure includes deflection electrodes connected to the control unit for controlling the deflection of pigment particles during transport to deflect pigment particles against predetermined locations on the first face of the image receiving member in view of the image which is to be printed by application of predetermined deflection voltages.

19. A direct electrostatic printing device according to claim 1, wherein the image receiving member is an information carrier.

20. A direct electrostatic printing device according to claim 1, wherein the image receiving member is a transfer belt positioned at a predetermined distance from the printhead structure, the transfer belt being substantially of uniform thickness, whereby a pigment image is subsequently transferred from the transfer belt to an information carrier.

21. A direct electrostatic printing device according to claim 20, wherein the transfer belt is supported by at least one holding element arranged on the second face side of the transfer belt.

22. A direct electrostatic printing device according to claim 20, wherein a first face of the transfer belt is substantially evenly coated with a layer of bouncing reduction agent to provide a surface on the first face of the transfer belt that the pigment particles transported through the print head structure substantially adhere to substantially without bouncing.

23. A direct electrostatic printing device according to claim 20, further comprising a transfuser having heating means and pressurizing means for transferring a pigment image on the surface of the first face of the image receiving member to the information carrier by the heating means and pressurizing means locally applying heat and pressure to the information carrier and the pigment image and thereby transferring the pigment image to the information carrier.

24. A method for printing an image to an information carrier comprising the steps of:

providing pigment particles from at least two pigment particle sources;

moving an image receiving member and at least one printhead structure relative to each other during printing;

creating an electrical field for transporting pigment particles from the pigment particle sources toward a first face of the image receiving member;

selectively opening or closing apertures through the printhead structure to permit or restrict the transport of pigment particles to enable the formation of a multiple pigment image on the first face of the image receiving member, the apertures being aligned in at least one row per pigment particle source in a direction substantially perpendicular to the relative movement between the image receiving member and the at least one printhead structure, each pigment particle source being associated with a part bit map for formation of a part pigment image; and virtually adjusting at least one part bit map positionally to align the part pigment images formed by the respective pigment particle sources with each other, thereby enabling the formation of a correctly aligned multiple pigment image even though the at least one row of apertures related to one particle source and the at least one row of apertures related to the at least one other particle source are mechanically misaligned.

* * * * *